US007630672B2

(12) United States Patent
Baretsky et al.

(10) Patent No.: US 7,630,672 B2
(45) Date of Patent: Dec. 8, 2009

(54) SYSTEM AND METHOD FOR DETERMINING AND CORRECTING COLOR SEPARATION REGISTRATION ERRORS IN A MULTI-COLOR PRINTING SYSTEM

(75) Inventors: Thomas M. Baretsky, Fairport, NY (US); Anne K. Fitzpatrick, Rochester, NY (US); David Kerxhalli, Rochester, NY (US); Wayne Morganti, Brockport, NY (US); Mark S. Petrush, Webster, NY (US); Mark Alan Scheuer, Williamson, NY (US); Rod Stair, Churchville, NY (US); James W. Stevens, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 232 days.

(21) Appl. No.: 11/804,851

(22) Filed: May 21, 2007

(65) Prior Publication Data

US 2008/0292368 A1 Nov. 27, 2008

(51) Int. Cl.
*G03G 15/01* (2006.01)

(52) U.S. Cl. ..... 399/301; 399/39; 399/40; 347/116

(58) Field of Classification Search ..... 399/39, 399/40, 301; 347/116
See application file for complete search history.

(56) References Cited

U.S. PATENT DOCUMENTS

| | | | |
|---|---|---|---|
| 4,391,505 | A | 7/1983 | Silverberg |
| 4,546,700 | A | 10/1985 | Kishner et al. |
| 4,788,116 | A | 11/1988 | Hochberg |
| 4,831,420 | A | 5/1989 | Walsh et al. |
| 4,937,664 | A | 6/1990 | Chiku et al. |
| 5,081,507 | A | 1/1992 | Monkelbaan et al. |
| 5,184,011 | A | 2/1993 | Hubble, III et al. |
| 5,227,815 | A | 7/1993 | Dastin et al. |
| 5,260,725 | A | 11/1993 | Hammond |
| 5,272,493 | A | 12/1993 | Hubble, III et al. |
| 5,278,625 | A | 1/1994 | Charnitski et al. |
| 5,287,162 | A | 2/1994 | de Jong et al. |
| 5,329,466 | A | 7/1994 | Monney |
| 5,339,150 | A | 8/1994 | Hubble, III et al. |
| 5,339,159 | A | 8/1994 | Nakamura et al. |
| 5,342,715 | A | 8/1994 | Kamath et al. |
| 5,384,592 | A | 1/1995 | Wong |
| 5,406,066 | A | 4/1995 | Steinle et al. |

(Continued)

OTHER PUBLICATIONS

Hains, "The Influence of Halftone Orientation on Color Gamut", Recent Progress in Digital Halftoning, IS&T Pub. (1995).

(Continued)

*Primary Examiner*—David M Gray
*Assistant Examiner*—G. M. Hyder
(74) *Attorney, Agent, or Firm*—Carter, DeLuca, Farrell & Schmidt, LLP

(57) ABSTRACT

A system and method for determining a color separation registration error in a multi-color printing system are provided. The system and method provide for instructing first and second color separations to mark a substrate with first and second fine-periodic-patch images to determine color separation registration error(s). The system and method further provide for determining whether at least an about half-period color separation registration error exists between the first and second color separations.

15 Claims, 17 Drawing Sheets

U.S. PATENT DOCUMENTS

| | | | |
|---|---|---|---|
| 5,418,556 | A | 5/1995 | Andrews |
| 5,457,518 | A | 10/1995 | Ashikaga et al. |
| 5,523,823 | A | 6/1996 | Ashikaga |
| 5,526,140 | A | 6/1996 | Rozzi |
| 5,537,190 | A | 7/1996 | Folkins et al. |
| 5,572,601 | A | 11/1996 | Bloomberg |
| 5,574,527 | A | 11/1996 | Folkins |
| 5,600,404 | A | 2/1997 | Ando et al. |
| 5,631,686 | A | 5/1997 | Castelli et al. |
| 5,689,425 | A | 11/1997 | Sainio et al. |
| 5,760,815 | A | 6/1998 | Genovese |
| 5,768,671 | A | 6/1998 | Komiya et al. |
| 5,774,156 | A | 6/1998 | Guerin |
| 5,778,280 | A | 7/1998 | Komiya et al. |
| 5,793,901 | A | 8/1998 | Matsutake et al. |
| 5,808,658 | A | 9/1998 | Hoover |
| 5,825,984 | A | 10/1998 | Mori et al. |
| 5,887,996 | A | 3/1999 | Castelli et al. |
| 5,909,235 | A | 6/1999 | Folkins |
| 5,973,718 | A | 10/1999 | Charnitski et al. |
| 5,995,802 | A | 11/1999 | Mori et al. |
| 6,014,154 | A | 1/2000 | Guerin |
| 6,035,076 | A | 3/2000 | Nagase |
| 6,129,015 | A | 10/2000 | Dewey |
| 6,133,932 | A | 10/2000 | Webb et al. |
| 6,148,168 | A | 11/2000 | Hirai et al. |
| 6,154,628 | A | 11/2000 | Kawano |
| 6,164,847 | A | 12/2000 | Allen |
| 6,185,402 | B1 | 2/2001 | Linssen |
| 6,198,490 | B1 | 3/2001 | Eom et al. |
| 6,198,549 | B1 | 3/2001 | Decker et al. |
| 6,198,550 | B1 | 3/2001 | Toyoda |
| 6,215,512 | B1 | 4/2001 | Imaizumi et al. |
| 6,236,470 | B1 | 5/2001 | Seachman |
| 6,239,828 | B1 | 5/2001 | Ito et al. |
| 6,246,857 | B1 | 6/2001 | Tanaka |
| 6,253,678 | B1 | 7/2001 | Wentworth |
| 6,275,244 | B1 | 8/2001 | Omelchenko et al. |
| 6,288,556 | B1 | 9/2001 | Sato et al. |
| 6,292,208 | B1 | 9/2001 | Lofhus et al. |
| 6,295,435 | B1 | 9/2001 | Shinohara et al. |
| 6,300,968 | B1 | 10/2001 | Kerxhalli et al. |
| 6,310,681 | B1 | 10/2001 | Taniwaki |
| 6,321,060 | B1 | 11/2001 | Nakayasu et al. |
| 6,336,024 | B1 | 1/2002 | Kanaya et al. |
| 6,369,842 | B1 | 4/2002 | Abramsohn |
| 6,381,428 | B1 | 4/2002 | Yamamoto et al. |
| 6,434,279 | B1 | 8/2002 | Shiba |
| 6,441,915 | B1 | 8/2002 | Imaizumi et al. |
| 6,449,060 | B1 | 9/2002 | Kawai et al. |
| 6,456,310 | B1 | 9/2002 | Wallace et al. |
| 6,456,311 | B1 | 9/2002 | Harush et al. |
| 6,462,821 | B1 | 10/2002 | Borton et al. |
| 6,493,010 | B1 | 12/2002 | Takahashi et al. |
| 6,493,011 | B1 | 12/2002 | Shioya |
| 6,493,064 | B2 | 12/2002 | Cabiri et al. |
| 6,493,083 | B2 | 12/2002 | Parisi et al. |
| 6,526,240 | B1 | 2/2003 | Thomas et al. |
| 6,529,616 | B1 | 3/2003 | Rasmussen et al. |
| 6,556,313 | B1 | 4/2003 | Chang et al. |
| 6,643,035 | B1 | 11/2003 | Salgado |
| 6,644,773 | B2 | 11/2003 | Bildstein et al. |
| 6,804,485 | B2 | 10/2004 | Martin et al. |
| 6,842,590 | B2 | 1/2005 | Dalal et al. |
| 6,856,336 | B2 | 2/2005 | Toyoda |
| 6,889,028 | B1 | 5/2005 | Hunold et al. |
| 6,909,516 | B1 | 6/2005 | Hoover |
| 6,911,993 | B2 | 6/2005 | Nishikawa et al. |
| 6,970,660 | B2 * | 11/2005 | Harada et al. |
| 6,973,272 | B2 | 12/2005 | Yamamoto et al. |
| 7,002,701 | B1 | 2/2006 | Nakayasu et al. |
| 7,013,094 | B2 | 3/2006 | Dalal et al. |
| 7,013,803 | B2 | 3/2006 | Hansen et al. |
| 7,039,348 | B2 | 5/2006 | Kerxhalli et al. |
| 7,071,957 | B2 | 7/2006 | Fujimoto |
| 7,075,561 | B2 | 7/2006 | Ozawa et al. |
| 7,085,009 | B2 | 8/2006 | Kawai et al. |
| 7,100,508 | B1 | 9/2006 | Mader |
| 7,106,477 | B2 | 9/2006 | Horobin |
| 7,127,125 | B2 | 10/2006 | Perlmutter et al. |
| 2001/0017645 | A1 | 8/2001 | Toda |
| 2001/0021208 | A1 | 9/2001 | Ueyanagi et al. |
| 2001/0033395 | A1 | 10/2001 | Chizawa |
| 2001/0033686 | A1 | 10/2001 | Klassen |
| 2002/0102114 | A1 | 8/2002 | Kawanishi |
| 2002/0113968 | A1 | 8/2002 | Parisi et al. |
| 2002/0118350 | A1 | 8/2002 | Cabiri et al. |
| 2002/0122124 | A1 | 9/2002 | Suda |
| 2002/0159802 | A1 | 10/2002 | Katahira |
| 2003/0002043 | A1 | 1/2003 | Abdulhalim et al. |
| 2003/0044193 | A1 | 3/2003 | Thomas et al. |
| 2003/0052959 | A1 | 3/2003 | Fujimoto |
| 2003/0053093 | A1 | 3/2003 | Eom |
| 2003/0090689 | A1 | 5/2003 | Klassen |
| 2003/0098985 | A1 | 5/2003 | Horobin et al. |
| 2003/0145745 | A1 | 8/2003 | Hansen et al. |
| 2003/0145751 | A1 | 8/2003 | Hansen et al. |
| 2003/0174184 | A1 | 9/2003 | Bildstein et al. |
| 2003/0197877 | A1 | 10/2003 | Lee |
| 2003/0214568 | A1 | 11/2003 | Nishikawa et al. |
| 2004/0046981 | A1 | 3/2004 | Taka et al. |
| 2004/0076450 | A1 | 4/2004 | Martin et al. |
| 2004/0114025 | A1 | 6/2004 | Kerxhalli et al. |
| 2004/0130737 | A1 | 7/2004 | Kamimura et al. |
| 2004/0175196 | A1 | 9/2004 | Yamamoto et al. |
| 2004/0239746 | A1 | 12/2004 | Ozawa et al. |
| 2005/0047834 | A1 * | 3/2005 | Tomita et al. ..... 399/301 |
| 2005/0069220 | A1 | 3/2005 | Czyszczewski et al. |
| 2005/0093956 | A1 | 5/2005 | Egan |
| 2005/0111759 | A1 | 5/2005 | Perlmutter et al. |
| 2005/0134874 | A1 | 6/2005 | Overall et al. |
| 2005/0157297 | A1 | 7/2005 | Abdulhalim et al. |
| 2005/0206934 | A1 | 9/2005 | Nishikawa et al. |
| 2005/0206980 | A1 | 9/2005 | Nishikawa et al. |
| 2005/0208685 | A1 | 9/2005 | Abdulhalim et al. |
| 2005/0214037 | A1 | 9/2005 | Kishi |
| 2006/0001765 | A1 | 1/2006 | Suda |
| 2006/0005722 | A1 | 1/2006 | Nobukawa et al. |
| 2006/0013603 | A1 | 1/2006 | Matsuyama |
| 2006/0056882 | A1 | 3/2006 | Kwon et al. |
| 2006/0065625 | A1 | 3/2006 | Abdulhalim et al. |
| 2006/0114282 | A1 | 6/2006 | Mizes et al. |
| 2006/0114283 | A1 | 6/2006 | Mizes et al. |
| 2006/0115303 | A1 | 6/2006 | Kang et al. |
| 2006/0119690 | A1 | 6/2006 | Park |
| 2006/0120626 | A1 | 6/2006 | Perlmutter et al. |
| 2006/0120772 | A1 | 6/2006 | Kitazawa et al. |
| 2006/0132807 | A1 | 6/2006 | Abdulhalim et al. |
| 2006/0139433 | A1 | 6/2006 | Yoshida |
| 2006/0164506 | A1 | 7/2006 | Kitao |
| 2006/0171748 | A1 | 8/2006 | Inui et al. |
| 2006/0176354 | A1 | 8/2006 | Yoshida |
| 2006/0176355 | A1 | 8/2006 | An |
| 2006/0177246 | A1 | 8/2006 | Kawada et al. |
| 2006/0182472 | A1 | 8/2006 | Munakata et al. |
| 2006/0191437 | A1 | 8/2006 | Mader |
| 2006/0244980 | A1 | 11/2006 | Grace |
| 2006/0262326 | A1 | 11/2006 | Abdulhalim et al. |
| 2006/0263120 | A1 | 11/2006 | Hayakawa |
| 2006/0275057 | A1 | 12/2006 | Suzuki |
| 2006/0290767 | A1 | 12/2006 | Tezuka et al. |
| 2007/0003332 | A1 | 1/2007 | Kim |
| 2007/0019056 | A1 | 1/2007 | Jung et al. |
| 2007/0048031 | A1 | 3/2007 | Kinoshita |

2007/0077059 A1 4/2007 Denoue et al.
2007/0115339 A1 5/2007 Matsuzaki et al.

OTHER PUBLICATIONS

Oztan et al., "Quantitive Evaluation of Misregistration Induced Color Shifts in Color Halftones", Electronic Imaging, vol. 5667, p. 225 (2000).

Yang et al., "Light Scattering and Ink Penetration Effects on Tome Reproduction", Pics 2000: Image Processing, Sys, Conf., Portland, OR, p. 225 (2000).

Arney et al., "Kubelka-Munk Theory and the MTF of Paper", Journ. of Imaging Science and Tech., vol. 47, No. 4, p. 339 (2003).

* cited by examiner

SYSTEM AND METHOD FOR DETERMINING AND CORRECTING COLOR SEPARATION REGISTRATION ERRORS IN A MULTI-COLOR PRINTING SYSTEM

BACKGROUND

1. Technical Field

The present disclosure relates to multi-color printing systems, and, in particular, to a system and method for determining and correcting color separation registration errors in a multi-color printing system.

2. Description of Related Art

In some multi-color printing systems, such as xerographic multi-color printing systems, multiple color separations are used for marking a substrate, e.g., paper. Usually each separation marks the substrate with only one specific ink (or toner) color; and each separation marks the substrate with a differing color from the other separations, e.g., one separation marks with cyan ink (or toner) while another marks with magenta ink (or toner, hence the adjective "color" in the phrase "color separation"). Also, certain technologies may form a complete multi-color complementary image on an intermediary device before transferring the complementary image to a substrate, e.g., in electrophotographic systems each color separation may cumulatively form a multi-color complementary image on an intermediate substrate before transferring the complementary image to paper.

Although only four different color separations, and hence, four different inks (or toners) are generally used in multicolor printing, a much wider variety of colors are available for perception because of the psychophysical aspects of human vision. For example, small dots of two differing colors located close together may be perceived as an entirely different color when viewed from a sufficient distance because of various aspects of human color perception.

When forming cluster-dot halftone screens, each color separation marks the substrate with discrete shapes, such as dots having a circular or oval shape, or periodic line patterns. This concept is generally known as color half-toning, and involves marking two or more patterned color separations on the substrate. A marked pattern formed by one color separation is generally referred to as a halftone pattern. The selection of the color separation inks (or toners) and the halftone patterns are carefully chosen to achieve a desired visual perception of the desired color.

Many multi-color printing systems utilize cyan, magenta, yellow, and black (also referred to as CMYK) color separations to mark a substrate. The dots may be marked in a dot-on-dot fashion, where each color separation marks dots on top of other dots formed by other color separations; the idea is to achieve a color by superimposing the various separation dots on each other. This creates colors not possible with only one color separation. Dots may also be marked in a dot-off-dot fashion, where the dots of one color separation are placed in the voids of the dots of another color separation. This too can achieve colors not possible by utilizing only one color separation.

However, a subtype category of multi-color printing systems is "highlight color" printing systems, which utilize only two color separations. One of the separations used by highlight color printing systems is usually a black color separation, while the highlight color separation uses a "highlight" color. The highlight color separation usually marks with red ink (or toner), although other colors may be used. Typically, highlight color printing is used to create printed material that is similar in cost to monochrome printers, but has the addition of the highlight color to draw the attention of a reader to a certain item, graphic and/or slogan. For example, many advertisements may have numerous items for sale, but the advertiser may want to highlight a particular item. That item may be printed in the highlight color to grab the attention of the reader. Also, highlight color printing systems are usually capable of a relatively high degree of printing quality at speeds that are comparable to monochrome color printing systems.

However, multi-color printing systems and highlight color printing systems are susceptible to color separation registration errors between color separations due to a variety of mechanical related issues. For example, the color separations may be orientated differently in one direction compared to another direction due to the mechanical tolerances of the color separations; also, vibrations may create localized registration errors by slightly moving a color separation in an undesirable fashion for a short time. For both dot-on-dot and dot-off-dot color-halftone rendering, and highlight color printing, color separation registration errors may cause a significant color shift in the actual printed color that is noticeable by the human eye. Additionally, an unintentional "beating" pattern may appear when viewing a printed image with color separation registration errors. These patterns are called moiré patterns.

Most highlight color printing systems utilize either "image on image" (IOI) highlight color printing or "image-next-to-image" (INI) highlight color printing. Image on image highlight color printing includes marking paper with a black ink (or toner) and a highlight color ink (or toner). The IOI printing system combines the colors of the two color separations to have different shades and/or visual effects on the printed material by combing the two inks or toners visually. For example, it may be easier to create different shades of red by combining black and red cluster-dots. Image-next-to-image highlight color printing usually involves marking separate and distinct regions of a substrate, e.g., paper, with the highlight color and black in the remaining areas. For example, consider a printing system that is tasked to print advertisements about a sale: an advertisement flyer may include several price examples with accompanying graphics all in black, except for the top of the flyer that may have the words "SALE ALL DAY THURSDAY!" printed thereon in the highlight color, e.g., red.

Typically, not all print jobs utilize the highlight color separation of a highlight color printing system. The highlight color separation aspect of the system may be turned off and/or placed in an intermediate standby mode while the "black-only" printing jobs are printed. Additionally or alternatively, the entire printing system may be offline for an extended period, e.g., such as during a weekend and/or vacation period of the operators of the system. Because of these periods of inactivity or quasi-inactivity, the various components and/or elements of a printing system may cool off and misalign resulting in a color separation registration error.

For example, some printing systems utilize a Raster Output Scanner (referred to herein as "ROS"). A ROS may consist of a laser beam source that is sent through various mirrors and lenses and onto a rotating polygon mirror, which is utilized to form an image on a photoreceptor. When "black-only" printing jobs run for an extended period of time, large thermal variation of the black ROS can cause registration errors because of thermal shifts in the mirror or lens mounts. Once the highlight color separation is turned on, the color separation registration error may need correcting. Although utilizing a ROS is an option, a printing system may also utilize a Light Emitting Diode (referred to herein as "LED") bar to form an image as well. However, both the ROS and LED configurations are susceptible to color separation registration errors.

Consider that on a 600 dpi system a color separation registration error of 8 pixels may be about 338 microns and a color separation registration error of 16 pixels on the same system may be about 677 microns; also consider that on certain highlight color printing systems, the ROS heating and cooling can cause a color separation registration error of greater than 400 microns, while the printing system in aggregate may have a color separation registration errors of greater than 600 microns. The color separations registration errors within a highlight color printing system created by thermal expansion and contraction may be significant enough to increase the need to utilize color separation registration error correcting technologies.

Additionally or alternatively, a photoreceptor belt and/or drum may experience thermal expansion causing additional color separation registration errors to occur. The belt may consist of a coated belt of biaxially-oriented polyethylene terephthalate (boPET) polyester film that is seam welded and is ran in tension on a belt module. The tension roll on the belt module may be between the black and the highlight color separations and may expand or contract as the temperature of the roll and/or belt module varies. However, by utilizing a drive roll that is a Thin Wall Elastomer Drive Roll (TWEDR) some of the color separation registration errors resulting from thermal variation are mitigated. The dynamic nature of the many aspects, components and/or modules of a multi-color printing system has created a need for correcting and/or determining color separation registration errors in a printing system.

A marking technology that mitigates some of these anomalies utilizes rotated cluster dot sets. When using rotated cluster dot sets, the registration error artifacts are more subtle and less detectable by the human eye. However, even in these cases, color separation registration errors may create objectionable images, particularly at the edges of objects that contain more than one color separation. The use of "trapping" areas help to alleviate the effects of registration errors at color boundaries, but the area of the trap is a function of the color separation registration error. Therefore, it is desirable to determine color separation registration errors in order to enhance corrective action to mitigate these and other anomalies.

Various techniques have been used to determine color separation registration errors, such as examining the cluster dots under a microscope. Sometimes, a small patch is printed in the corner of the substrate so that microscope examination may be facilitated. Some of these patches can only be used to measure the color separation registration error in either the fast scan direction (transverse to the longitudinal axis of the photoreceptor belt) or the slow scan direction (parallel to the longitudinal axis of the photoreceptor belt). Multiple patches may also be used to determine the color separation registration error in multiple directions and/or multiple locations.

Control patches are a group of related technologies that are utilized for controlling, adjusting, correcting, and/or determining one or more aspects of a printing system. For example, one kind of patch may facilitate determining color separation registration errors; this kind of patch may be referred to a "color separation registration error" patch or other descriptive name. A "patch image" is the information and/or instructions sent to the color separations. A "patch image as marked on the substrate" is a "patch". The distinction between a "patch" and a "patch image" is illustrated by noting the difference between what the color separations are instructed to mark (i.e., a "patch image") and what is actually marked on the substrate (i.e., the "patch"). Thus, a "patch image" as marked on a substrate is a "patch".

For example, a bitmap file may correspond to a "patch image" and may be configured to determine color separation registration errors. The patch image may be deliberately designed to change in appearance as marked on the substrate as a function of color separation registration error. By examining the patch, the system may be able to determine the color separation registration errors based upon the differences between the bitmap file (the "patch image", which the separations were instructed to mark) and how the bitmap file was actually marked (i.e., the patch).

With the printer speeds and/or smaller cluster dot sizes now possible there is a need to determine color separation registration errors by utilizing patches and/or patch images to mitigate, correct, or eliminate unwanted artifacts such as moiré patterns, color shifts, and/or other anomalies.

SUMMARY

A system and method are disclosed herein. The system and method may be used for determining color separation registration error(s) in multi-color printing systems, e.g., a highlight color printing system. The system and method may instruct first and second color separations to mark a substrate with a first fine-periodic-patch image, described in more detail infra. The system and method disclosed herein further provide for instructing the first and second color separations to mark the substrate with a second fine-periodic-patch image, also described in more detail infra. In addition, the disclosed subject matter includes a system and method for determining whether at least an about half-period color separation registration error exists between the first and second color separations. A color separation registration error may have the property of a period as described herein because of the periodic nature of the patch images described in more detail below.

In particular, the method in accordance with the present disclosure provides for determining color separation registration error in a multi-color printing system. The method includes instructing first and second color separations to mark a substrate with a first fine-periodic-patch image. The first fine-periodic-patch image may be configured to have a reduced total area of coverage as marked on the substrate when greater than an approximate no color separation registration error to an about half-period color separation registration error of the second color separation in a first direction exists. The property of total area of coverage of a patch image as marked on a substrate is discussed in more detail infra. Additionally, the first fine-periodic-patch image is further configured to have a reduced total area of coverage as marked on the substrate when greater than an approximate no color separation registration error to an about half-period color separation registration error of the first color separation in the opposite first direction exists.

The disclosed method also includes instructing the first and second color separations to mark the substrate with a second fine-periodic-patch image. The second fine-periodic-patch image is configured to have a reduced total area of coverage as marked on the substrate when greater than an approximate no color separation registration error to an about half-period color separation registration error of the second color separation in a second direction exists. The second fine-periodic-patch image may be further configured to have a reduced total area of coverage as marked on the substrate when greater than an approximate no color separation registration error to an about half-period color separation registration error of the first color separation in the opposite second direction exists. The method also includes determining whether at least an about half-period color separation registration error exists between the first and second color separations.

The first fine-periodic-patch image may include at least one line pair having first and second lines. The first line may be a first color of the first color separation and the second line may be a second color of the second color separation. Additionally or alternatively, the second fine-periodic-patch image may include at least one line pair having first and second lines. The first line of the second fine-periodic-patch image may be the first color of the first color separation and the second line of the second fine-periodic-patch image may be the second color of the second color separation. Additionally, the first fine-periodic-patch image may have the first line adjacent to the second line in the first direction. Also, the second fine-periodic-patch image may have the first line adjacent to the second line in the second direction.

Consistent with the present disclosure, the step of determining whether at least an about half-period color separation registration error exists between the first and second color separations may include the step of determining whether an about half-period color separation registration error exists between the first and second color separations. Additionally or alternatively, the step of determining whether at least an about half-period color separation registration error exists between the first and second color separations may include the step of determining whether an about full-period color separation registration error exists between the first and second color separations.

In accordance with a methodology disclosed herein, the step of determining whether an about half-period color separation registration error exists between the first and second color separations may include a step (or sub-step) of instructing the first and second color separations to mark the substrate with a third fine-periodic-patch image and/or may further include the step of instructing the first and second color separations to mark the substrate with a fourth fine-periodic-patch image. The fourth fine-periodic-patch image may be shifted an about half-period in at least one of the first direction, the opposite first direction, the second direction, and the opposite second direction of at least one of the first color of the first color separation and the second color of the second color separation. Furthermore, the step of determining whether an about half-period color separation registration error exists between the first and second color separation may include examining at least one of the third and fourth fine-period-patch images as marked on the substrate. The examining may be conducted utilizing an Infrared Densitometer (Referred to herein as an "IRD"). An IRD may be used to examine a patch by measuring and/or estimating the total area of coverage of a patch image as marked on a substrate.

The step of examining at least one of the third and fourth fine-period-patch images as marked on the substrate may include comparing the approximated total area of coverage of the third fine-periodic-patch image as marked on the substrate to the approximated total area of coverage of the fourth fine-periodic-patch images as marked on the substrate. Finally, the comparison may result in determining whether an about half-period color separation registration error exists.

Once a half-period color separation registration error has been determined to exist, the printing system has an option to correct the error by shifting one of the color separations by a half-period. The resulting half-period color separation registration shift, if shifted in the wrong direction, may result in a full-period color separation registration error. For this and other reasons it may be desirable to have a methodology (discussed infra) that can determine if a full-period color separation registration error exists.

According to the present disclosure the step of determining whether an about full-period color separation registration error exists between the first and second color separations may include instructing the first and second color separations to mark the substrate with a first, second, and third coarse-patch images.

The first coarse-patch image may be configured to have an increased total area of coverage as marked on the substrate when an about full-period color separation error exists in at least one of the first, and second color separations in at least one of the first direction, the negative first direction, the second direction, and the negative second direction.

The second coarse-patch image maybe configured to have a reduced total area of coverage as marked on the substrate when an about full-period color separation registration error exists in at least one of the second color separations in the first direction, the second color separation in the negative second direction, the first color separation in the negative first direction, and the first color separation in the second direction.

Finally, the third coarse-patch image may be configured to have a reduced total area of coverage as marked on the substrate when an about full-period shift exists in at least one of the second color separations in the negative first direction, the second color separation in the second direction, the first color separation in the first direction, and the first color separation in the negative second direction. Any one of the first, second and/or third coarse-patch images may be a coarse-periodic-patch image and any one of the first, second and third coarse-patch images may be configured to have dimensions conducive to aliased readings.

Additionally or alternatively, the step of determining whether an about full-period color separation registration error exists between the first and second color separations may include the step of examining at least one of the first, second, and third coarse-patch images as marked on the substrate which may itself include comparing the approximated total areas of coverage of at least one of the first, second, and third coarse-patch images as marked on the substrate to the approximated total areas of coverage of at least one of the first, second, and third coarse-patch images as marked on the substrate.

The system in accordance with the present disclosure is implemented by an operative set of processor executable instructions configured to be executed by at least one processor for determining color separation registration error in a multi-color printing system. The system includes a communication module configured to receive a first data structure relating to a first fine-periodic-patch image as marked on a substrate by first and second color separations, and a second data structure relating to a second fine-periodic-patch image as marked on the substrate by the first and second color separations. The first and second data structures may relate to a first and second fine-periodic-patch image as described supra, respectively. Additionally, the communication module may be configured to receive a third and fourth data structure data structure related to a third and fourth fine-periodic-patch images as marked on the substrate by the first and second color separations; the third and fourth fine-periodic-patch images may be similar to the two described supra.

The system further includes a control module configured to operatively instruct the first and second color separations. The control module is in operative communication with the communication module. The system also includes an analysis module configured to determine whether at least an about half-period color separation registration error exists between the first and second color separations. The analysis module is in operative communication with the control module. Furthermore, it is to be appreciated by one of ordinary skill in the relevant art that the system disclosed herein may implement any of the methodologies described herein.

In yet another embodiment, a system implemented by an operative set of processor executable instruction configured to be executed by at least one processor for estimating color separation registration error is disclosed. The system includes a means for instructing first and second color separations to mark at least one fine-periodic-patch image, and a means for determining whether at least an about half-period color separation registration error exists between the first and second color separations.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
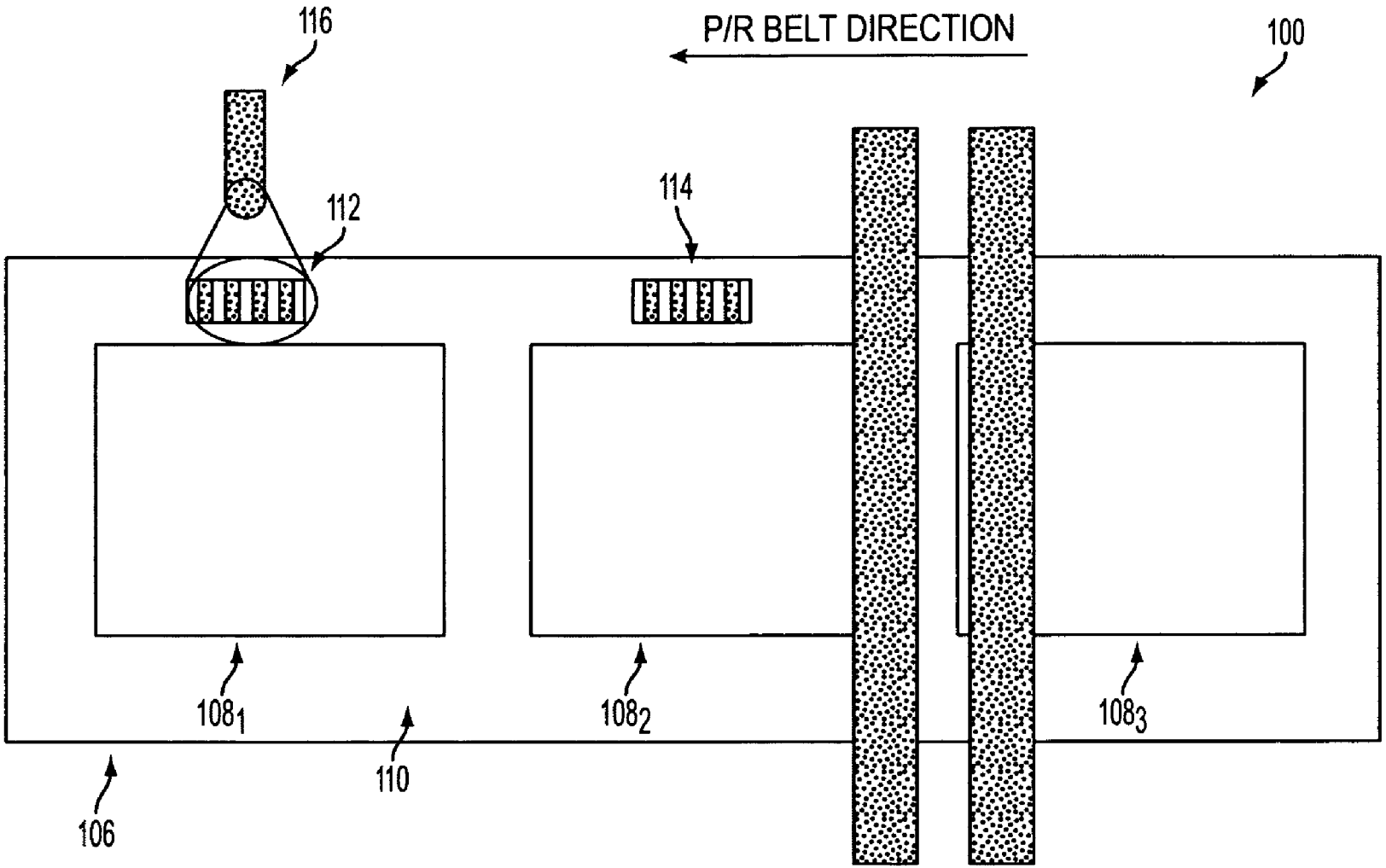
FIG. 1 is a graphic depicting an exemplary highlight color printing system that includes two color separations and a sensor that can examine patch images as marked on a substrate (i.e., patches) to determine color separation registration errors in accordance with the present disclosure.

Referring now to the drawings, FIG. 1 is a graphic depicting highlight color printing system 100. System 100 may include color separations 102 and 104. However, color separation 102 and 104 are depicted only to illustrate that more than one color separation may be utilized by methods 200, 300, 400, and/or system 1400, and is not intended to illustrate the way highlight color printing systems are implemented. For example, FIG. 1 depicts a system 100 that utilizes direct marking technology, however, the disclosed subject matter includes any marking technology including direct marking technologies, indirect marking technologies, or any other marking technology that can mark a substrate.

Color separations 102 and/or 104 may be any color used in color printing, highlight color printing and/or other printing system where more than one color separation is utilized. Additionally or alternatively, the particular colors of color separations 102 and 104 may be black, cyan, magenta, yellow or any other color. Color separations 102 and/or 104 may utilize ink or toner and may include intermediate devices (not shown) to mark substrate 106. However, separations 102 and 104 are to illustrate that two color separations may be used to marked substrate 106. In one particular embodiment, system 100 may be a xerographic system for marking substrate 106. Additionally or alternatively, a multiple pass marking engine may utilize multiple cycles of an electrophotographic process by forming an image on an intermediate device before the image is transferred to a substrate, e.g., paper.

System 100 may include a substrate 106. Substrate 106 is intended to illustrate the area that may be marked by system 100. Substrate 106 includes customer areas $\mathbf{108}_1$, $\mathbf{108}_2$ and $\mathbf{108}_3$. Substrate 106 may be paper, photo-paper, transparencies, printing paper, and/or other material capable of being marked. Any area of substrate 106 that customer areas $\mathbf{108}_1$, $\mathbf{108}_2$ and $\mathbf{108}_3$ do not occupy may be considered to be inter-document zone 110. Substrate 106 may be moved by a photoreceptor belt (also referred to as a p/r belt) in the direction indicated by an arrow labeled as "p/r belt direction" and shown with an accompanying arrow. The p/r belt may have been seam welded. A Thin Wall Elastimer Driver Roll (not shown) sometimes moves the belt. Usually the Roll has less than 1 pitch (8.5 inches for standard paper). The p/r belt is not depicted and may be considered to be below substrate 106. and may provide a technology to move substrate 106 in the direction indicated by the arrow labeled "p/r belt direction".

Inter-document zone 110 may be utilized for marking patches, as depicted in FIG. 1. However, in another embodiment, customer areas $\mathbf{108}_1$, $\mathbf{108}_2$ and/or $\mathbf{108}_3$ may be utilized for marking patches as well. Inter-document zone 110 may include the gap between successive customer images, such as customer areas customer areas $\mathbf{108}_1$, $\mathbf{108}_2$ and $\mathbf{108}_3$. Additionally or alternatively, the gap between customer areas $\mathbf{108}_1$, $\mathbf{108}_2$ and $\mathbf{108}_3$ may form an approximate 1 inch separation therebetween, which may also be used for marking patches (patches not depicted as marked within the aforementioned gaps in FIG. 1).

Also depicted are Patches 112 and 114. Patches 112 and/or 114 may be fine-periodic-patch images as marked on substrate 106, coarse-periodic-patch images as marked on a substrate 106, and/or coarse-patch images as marked on substrate 106. A coarse-patch image as marked on a substrate may be a non-periodic coarse-patch image configured to determine whether at least an about half-period color separation registration error exists, e.g., an image with only a single line of a first separation and a single line of a second separation. Additionally or alternatively, a coarse-patch image may be any patch that is configured such that a full-period color separation registration error in a direction or opposite direction is detectable when the coarse-patch is marked on a substrate. Patches 112 and 114 (or additionally marked patches) may also be used for various control functions such as to determine solid darkness, line darkness, halftone levels, and/or color separation registration (and related errors). As mentioned above, patches 112 and/or 114, and other patches are usually printed within inter-document zone 110. However, patches are usually not formed within the seam zones, i.e., the areas where the photoreceptor belt has been seam welded. These seam zones create thickness variations that may additionally distort anything marked on the substrate within that zone.

Patches 112 and 114 may be about 17 mm total length along the first direction (e.g., process direction) and about 25 mm total length along a direction orthogonal to the first direction (e.g., across the photoreceptor belt). Patches 112, 114, and/or other patches may be utilized to correct for low frequency errors. Low frequency errors are errors that vary between successive customer areas, but are somewhat consistent throughout a specific customer area. For example, an error that remains relatively consistent throughout customer area $\mathbf{108}_1$, but varies between customer areas $\mathbf{108}_1$ and $\mathbf{108}_2$, may be considered a low frequency error. High frequency errors are considered errors that vary within a customer area, such as an error that varies between the far left end of customer area $\mathbf{108}_1$ to the middle of customer area $\mathbf{108}_1$. The subject matter disclosed herein is described as being utilized to correct for low frequency color separation registration errors; however, the methods and/or systems described herein may be extended to include correcting and/or determining "high frequency" color separation registration error(s) as well.

In FIG. 1, assume that substrate 106 moves in the second direction (depicted by a labeled arrow). As mentioned supra, substrate 106 may be moved by a belt, a series of rollers and/or other substrate transporting technology. As substrate 106 moves in the second direction, patches 112 and 114 can be created by color separations 102 and/or 104. The color separations may be instructed by another device (not shown) to mark an image and/or patch image. When patch images are marked on substrate 106, patches 112 and/or 114 may result. Patches 112 and 114 may be designed to form on substrate 106 to indicate whether a color separation registration error exists between color separations 102 and 104.

For determining whether a color separation registration error exists between separations 102 and 104, sensor 116 may take a reading approximating the total area of coverage of patches 112 and/or 114. Based upon the estimated total areas of coverage whether a color separation registration error exists may be determined. Sensor 116 may be an ETAC sensor (High Light Color Extended Toner Area Coverage), which is sometimes used in highlight color printing systems. An ETAC sensor may have specular and/or diffuse sensing capability. The diffuse signal may be able to detect the full solid area mass of patches 112 and/or 114. Additionally or alternatively, sensor 116 may be an Infrared Densitometer (Referred to herein as an "IRD") as the one described in U.S. Pat. No. 6,462,821; the entire contents of which are incorporated herein by reference. Sensor 116 may have a field of view about 4 mm. Therefore, by utilizing a patch that is approximately 17 mm wide, sensor 116 may miss about 6.5 mm of the patch on both sides.

System 100 may utilize a feedback control system to determine whether a color separation registration error exists and/or to correct for a color separation registration error. For example, a P-I control system (proportional-integral control system) may be utilized to adjust color separations 102 and/or 104 to correct for a determined color separation registration error. A P-I control system may be utilized rather than a P-I-D control system (proportional-integral-differential) because P-I control systems tend to be less susceptible to high frequency noise. A control system component (not shown) may instruct color separations 102 and/or 104 to mark substrate 106 with patch images 112 and 114. Based upon any determined color separation registration error, sensor 116 may detect that error when reading patches 112 and/or 114. The control system may then make appropriate corrections either directly or indirectly by adjusting color separation 102 and 104. Additionally or alternatively, the adjustments may be made by mechanically adjusting color separations 102 and/or 104, by utilizing digital file image warping, by changing other aspects of system 100, and/or by changing other aspects of color separations 102 and/or 104.

Also, the control system may be configured to have one or more color separations to track a particular color separation, e.g., only color separation 104 is adjusted to account for variations registrations of color separation 102. For example, consider a typical highlight color printing system. The highlight color separation may be continually switched on and off because of the alternations between all black print jobs and highlight color print jobs; the black color separation may have less resulting thermal variation, thus having more stability. Therefore, in this example, it may be advantageous for the highlight color separation to be adjusted to account for the black color separation's registration rather than adjusting both or the black color separation's registration to correct for color separation registration errors.

Figure 2A:
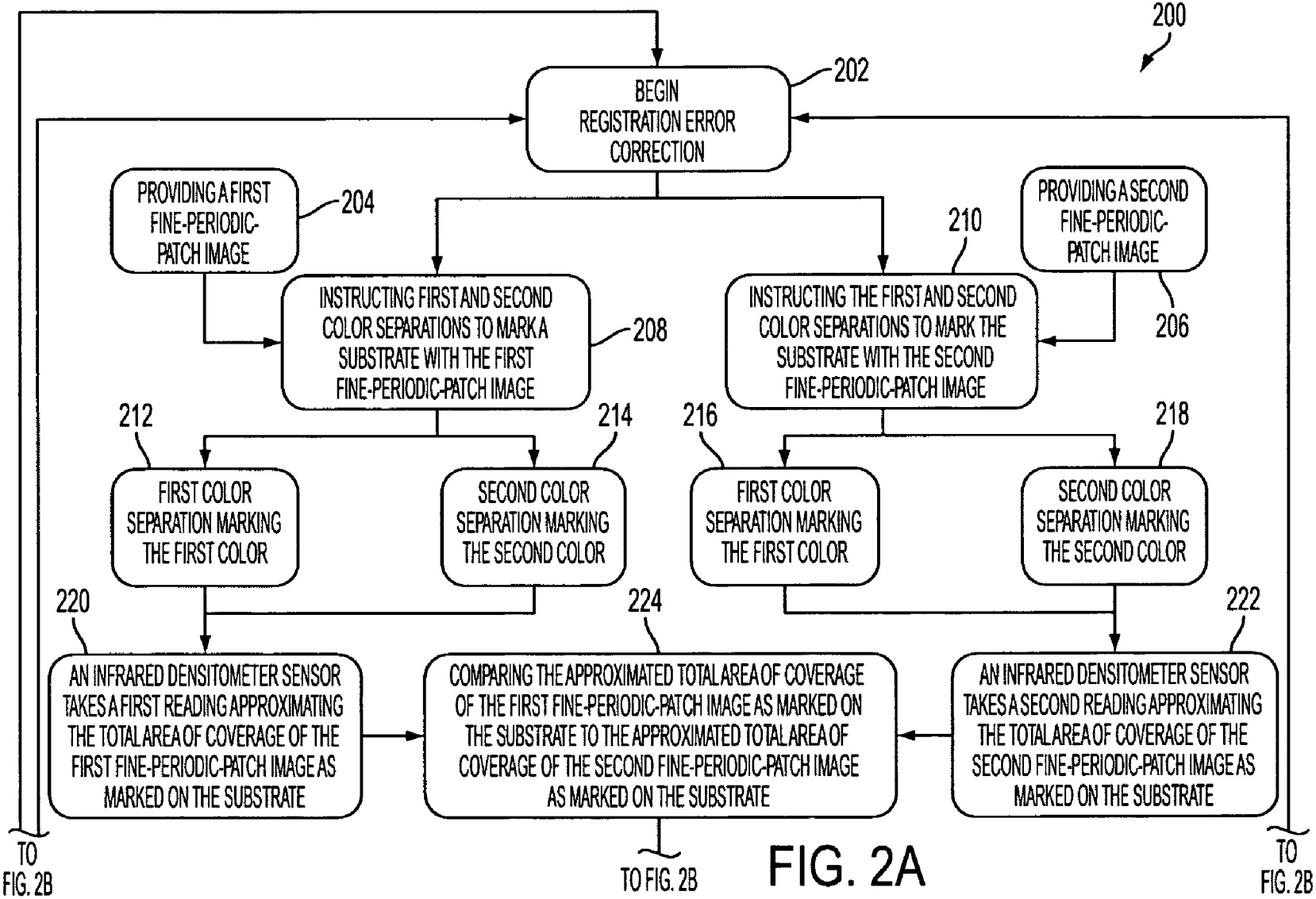
FIGS. 2A-2B are flow chart diagrams depicting a methodology providing color separation registration error correction including the step of determining whether at least an about half-period color separation registration error exists between the first and second color separations in accordance with the present disclosure.
Figure 2B:
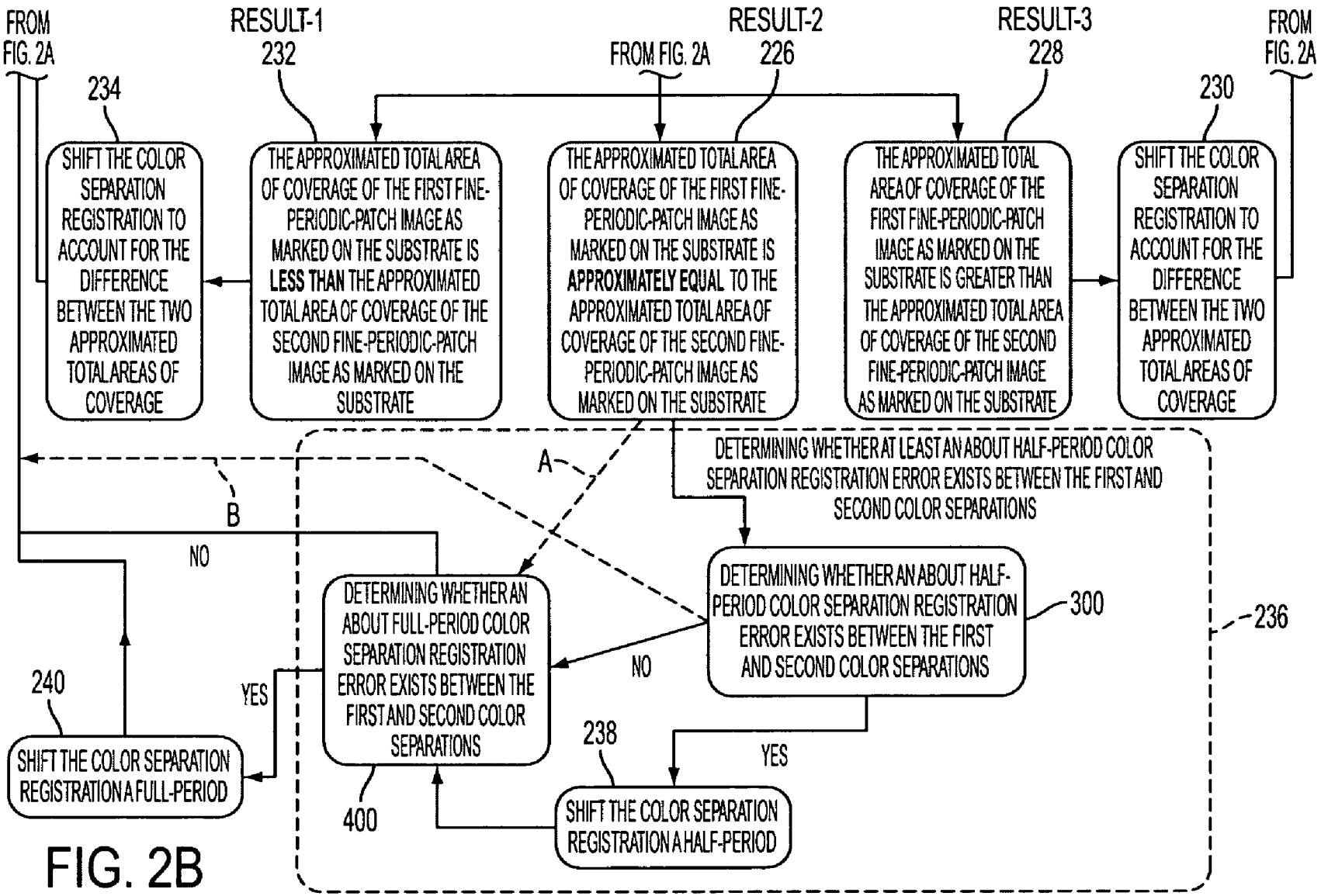

Referring now to FIGS. 1, 2, 3 and 4, system 100 of FIG. 1 may utilize methodologies illustrated by FIGS. 2, 3 and 4, respectively. Referring only to FIGS. 2A-2B, methodology 200 is depicted as a flow chart that can correct (or adjust) for a color separation registration error in accordance with the present disclosure. Methodology 200 may be initiated by a system call to a program, may be controlled by a control system, or otherwise may be implemented by utilizing any other technology. Additionally or alternatively, methodology 200 may be part of a control system, printing system and/or computer system. Methodology 200 may be implemented in hardware, software, software in execution, or some combination thereof. Also, methodology 200 may be part of an installable module installable in a printing system, such as a xerographic multi-color printing system.

Color separation registration error correction may begin at step 202. Step 202 may be initiated when a machine is turned on and/or when a color separation registration error exists. Steps 204 and 206 are providing first and second fine-periodic-patch images, respectively. Steps 204 and 206 may utilize an image stored in memory (e.g., a file), hardware, software, a combination of hardware and software, or the image may be formed by an algorithm. Additionally or alternatively, the first and second fine-periodic-patch images may comprise a set of instructions that may be sent to one or more color separations.

Step 208 is instructing first and second color separations to mark a substrate with the first fine-periodic-patch image; and step 210 is instructing the first and second color separations to mark the substrate with a second fine-periodic-patch image. Steps 212 is the first color separation marking the first color; and step 214 is the second color separation marking the second color. Steps 212 and 214 are utilized to mark the first fine-periodic-patch image that may be provided by step 204. Additionally, step 216 is the first color separation marking the first color; and step 218 is the second color separation marking the second color. Steps 216 and 218 are utilized to mark the second fine-periodic-patch image that may be provided by step 206.

Steps 212, 214, 216 and/or 218 may occur in any order, and may be performed in serial, in parallel, and/or some combination thereof. And steps 212, 214, 216 and/or 218 may be performed in a step wise fashion, e.g., step 212 is performed to 20% completion, then step 216 is performed to 20% completion, etc. Contrast steps 208 and 210 which include "instructing" the first and second color separations to steps 212 and 218 which include "marking" the substrate. As a result of an existence of a color separation registration error, the images as marked on the substrate (i.e., patch) may be different than the images the first and second color separations are instructed to mark in steps 208 and 210. The disparity that may occur between what the color separations are instruction to mark versus what the color separations actually mark may be utilized to correct and/or determine color separation registration errors in accordance with the present disclosure.

Referring simultaneously to FIGS. 2, 5A, 5B, 6A and 6B, an example of the disparity mentioned supra is illustrated. Image 500 of FIG. 5A may be a close-up view of the first fine-periodic-patch image mentioned supra regarding steps 204 and 208; and image 502 of FIG. 5B may be a close-up view of the second fine-periodic-patch image mentioned supra regarding steps 206 and 210.

Figure 5A:
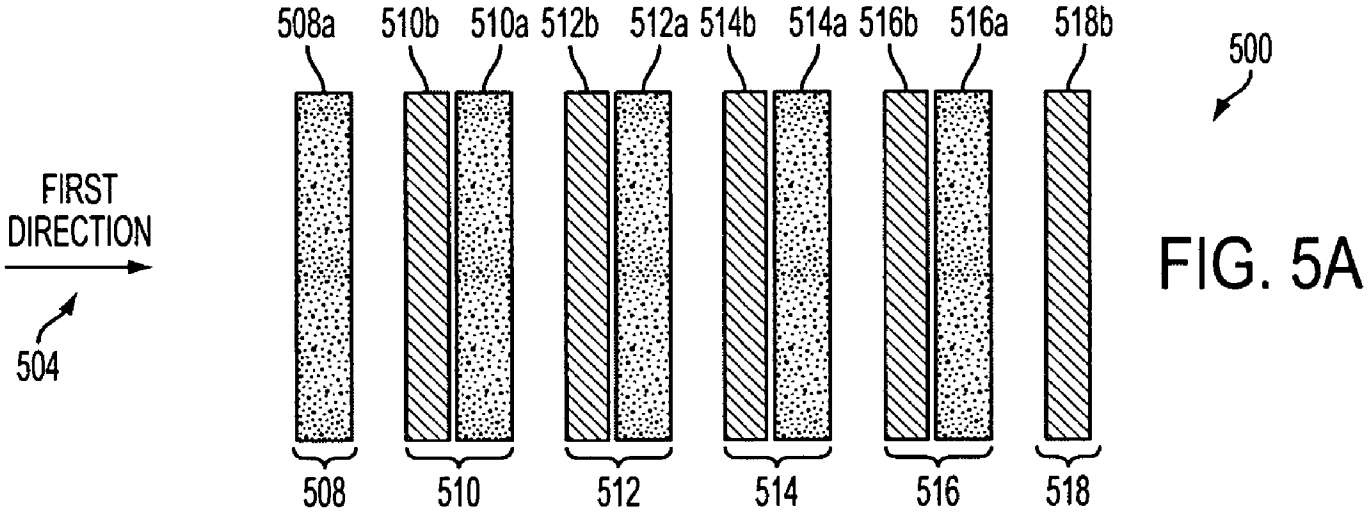
FIGS. 5A and 5B are graphics of two close-up views of two fine-periodic-patch images in accordance with the present disclosure.
Figure 5B:
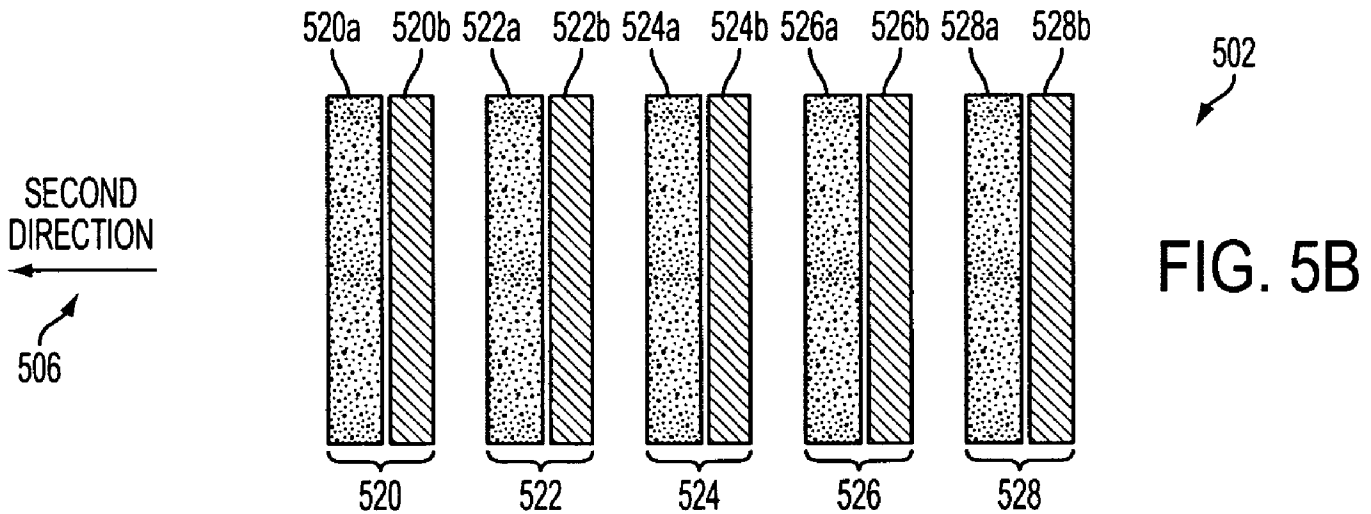
Figure 6A:
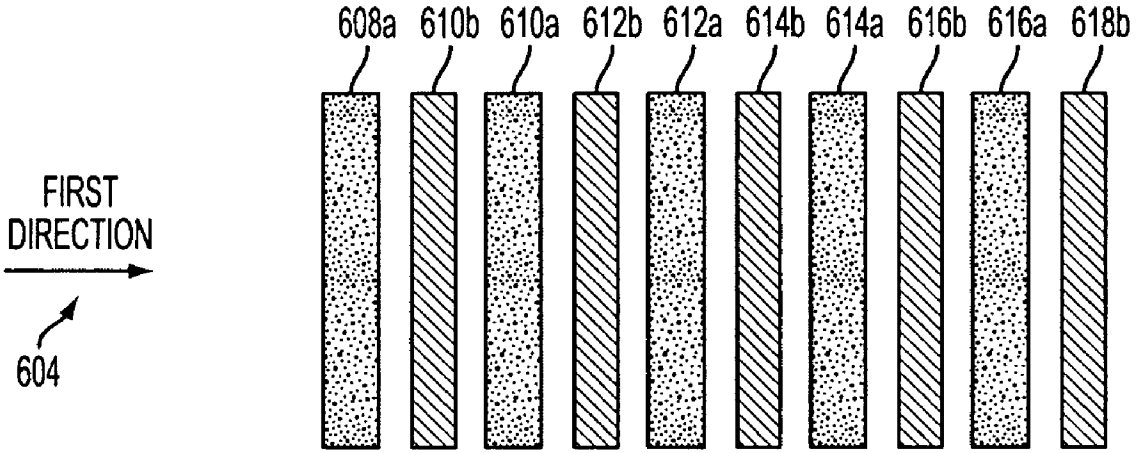
FIGS. 6A and 6B are graphics of two close-up views of two fine-periodic-patch images as marked on a substrate when color separation registration error exists in accordance with the present disclosure.
Figure 6B:
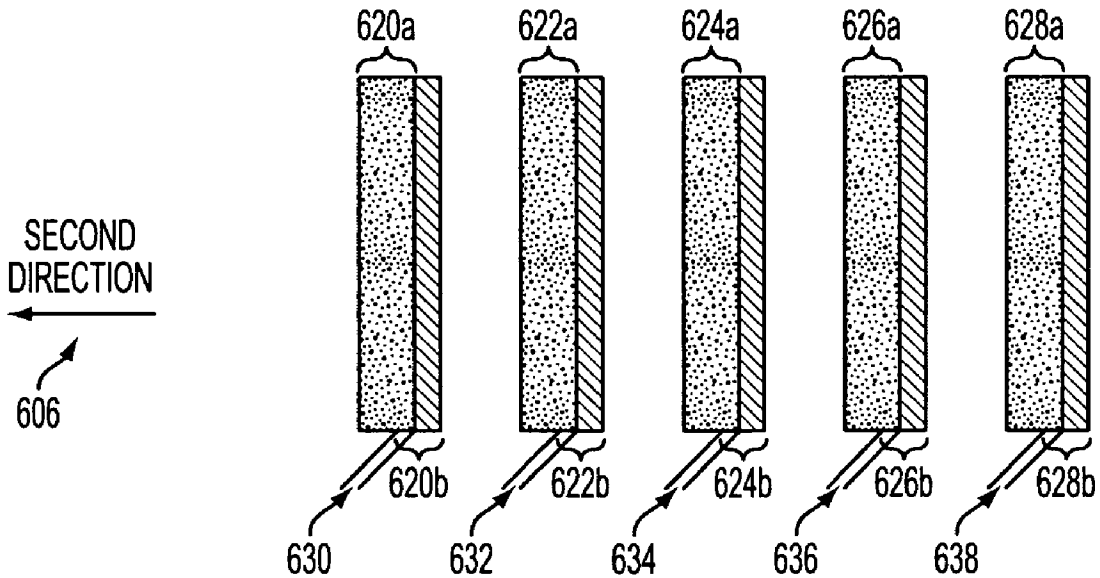

Patch 600 of FIG. 6A and patch 602 of FIG. 6B may result from two separations being instructed to mark image 500 of FIG. 5A and image 502 of FIG. 5B, respectively. The existence of color separation registration error may cause the disparity between image 500 and patch 600 and/or the disparity between image 502 and patch 602. The marking of the substrate may occur during steps 212, 214, 216 and/or 218 of FIGS. 2A-2B. The patches 600 and 602 of FIGS. 6A and 6B, respectively, are shown as close-up views. The manner in which images 500 and 502, and patches 600 and 602 are used to assist in determining color separation registration errors are discussed in more detail infra.

Referring simultaneously to FIGS. 5A and 5B, a close-up view of images 500 and 502 are depicted. Image 500 is a close-up view of a specific fine-periodic-patch image. A first direction and second direction are depicted as directional arrows in FIGS. 5A and 5B.

Image 500 includes line pairs 508 through 518 (although note that line pairs 508 and 518 are incomplete). Each of line pairs 508 through 516 has a corresponding line denoted by the letter "a". For example, line pair 510 includes line 510*a*. The lines denoted with the letter "a", may be of the color of a first color separation. For example, lines 508*a* thorough 516*a* may all be black, thus corresponding to the black color separation of a highlight color printing system.

Additionally or alternatively, line pairs 510 through 518 have a line associated with each respective line pair that is denoted by the letter "b", e.g., line pair 510 includes line 510*b*. Each of lines 510*b* through 518*b* are denoted by the letter "b" to point out that the "b" lines may be the color of a second color separation. For example, lines 508*a* thorough 516*a* may all be black, while lines 510*b* through 518*b* may be all red. The use of different line colors within image 500 is to utilize one color separation to mark lines with the letter "a" on the substrate and to utilize another color separation to mark the lines with the letter "b" on the substrate.

Although image 500 is a close-up view and is not to scale, the patch may have the dimensions of being about 17 mm total along the first direction (e.g., process direction) and about 25 mm along a direction orthogonal to the first direction (e.g., across the photoreceptor). Although only 6 line pairs are depicted (2 are incomplete), any number of line pairs may be used as long as the numbers of pairs used are an operatively sufficient amount for a sensor to take a proper reading (such as sensor 116 in FIG. 1).

Multiple line pairs may be used to form image 500; the line pairs may be made up of a pattern occurring every 16 pixels in the first direction creating a full-period of 16 pixels and a half-period of 8 pixels. The letter "a" lines, (e.g., lines 508*a* thorough 516*a*) may be marked by a first color separation (e.g., the black color separation) and may be 6 pixels wide (width is in the first direction 504) and may occur every 16 pixels, resulting in a repeating pattern of 6 pixels "on" and 10 pixels "off". A pixel may be about 42.333 microns when used in a 600 dots per inch system and/or device.

The letter "b" lines (e.g., lines 510*b* through 518*b*) may be marked by a second color separation (e.g., the highlight color separation, such as red) and may be 4 pixels wide which may occur every 16 pixels, resulting in a repeating pattern of 4 pixels "on" and 12 pixels "off". Additionally or alternatively, in yet another embodiment, lines 510*b* thorough 518*b* may be 5 pixels "on" and 11 pixels "off", however, in this embodiment there remains a 16 pixel periodic pattern, i.e. the full-period has a length of 16 pixels. The "b" lines may be shifted 5 pixels from the "a" lines in image 500.

When image 500 is marked on a substrate, an IRD (infrared densitometer) sensor may measure the image as marked on a substrate approximately near the center of image 500. Also note that an IRD sensor with a field of view of approximately 4 mm may not have the resolution to measure individual line pairs, but rather, may measure the approximated total area of coverage of image 500 as marked on a substrate. The incomplete line pairs (e.g., as depicted by line pairs 508 and 518) do not affect the measured approximated total area of coverage because either (1) the incomplete line pairs are outside the field of view of the IRD taking the reading and/or (2) the incomplete line pairs account for a negligible amount of the aggregate approximated total area of coverage.

Now refer to FIG. 5B, which depicts image 502. Image 502 may be marked by steps 216 and 218. Note that image 502 is substantially similar to image 500, except note that the line pairs are in a reverse position. Image 502 includes line pairs 520 through 528. Also note that the "a" may denote a color of the first separation and a "b" may denote a color of the second color separation. The pattern remains a 16 pixel pattern although; the first separation may be 6 pixels on and 10 pixels off (the "a" denotation).

Within image 502, the second separation lines denoted by "b" denotations may be 5 pixels on (denoted by the "b" lines) and 11 pixels off. The "on" and "off" may also be considered the line width (i.e. how many pixels "on") and the distance between the lines (i.e. how many pixels "off"). Additionally or alternatively, in yet another embodiment, the "b" lines may be 4 pixels on and 12 pixels off. The "b" lines may be shifted about 5 pixels from the "a" lines in image 502.

Note that images 500 and 502 are images that the first and second color separations may be instructed to mark on the substrate, e.g., steps 208 and 210, respectively (see FIGS. 2A-2B), rather than a depiction of an image as marked on the substrate (i.e. in this context, a patch).

Refer now simultaneously to FIGS. 5A, 5B, 6A, and 6B. Although two color separations may be instructed to mark images 500 and 502, because of a color separation registration error, the images as marked on the substrate may form patches 600 and 602. Note that all of the second color separation is shifted by a Δ by either the first separation in first direction 604 or by the second separation in the negative first direction 604. For simplicity consider in this example that the opposite of first direction 604 is equivalent to the second direction, and visa versa.

While referencing image 500 to patch 600 and image 502 to patch 602, note that the total area of coverage (also known as density or solid area mass) has been reduced as a result of color separation registration error. Note that each of line pairs 620 through 628 has undergone a reduction in total area of coverage because of the resulting overlaps 630 through 638. Measuring these total areas of coverage may facilitate determining color separation registration error.

With continued reference to FIGS. 2A-2B, in steps 220 and 222, a IRD sensor takes first and second readings of the respective total area of coverage of the first and second fine-periodic-patch images as marked on the substrate. The approximated total area of coverage of the first fine-periodic as marked on the substrate is compared to the approximate total area of coverage of the second fine-periodic image as marked on the substrate during step 224. Based upon those two readings one of result_1, result_2, or result_3 occurs.

Result_1 occurs when the approximated total area of coverage of the first fine-periodic patch image as marked on the substrate is less than the approximated total area of coverage of the second fine-periodic patch image as marked on the substrate, thus methodology 200 proceeds to step 232.

Result_2 occurs when the approximated total area of coverage of the first fine-periodic-patch image as marked on the substrate is approximately equal to the approximated total area of coverage of the second fine-periodic-patch image as marked on the substrate, thus methodology 200 proceeds to step 226.

Result_3 occurs when the approximated total area of coverage of the first fine-periodic patch image as marked on the substrate is greater than the approximated total area of coverage of the second fine-periodic patch image as marked on the substrate, thus methodology 200 proceeds to step 228.

Consider the case where the first and second fine-periodic-patch images as marked on the substrate in methodology 200 were patches 600 and 602 of FIGS. 6A and 6B, respectively. In this example, the approximated total area of coverage of the first fine-periodic-patch image as marked on the substrate is more the approximated total area of coverage of the second fine-periodic-patch image as marked on the substrate resulting in result_3. The registration of the second color separation may be shifted in first direction 604 to correct for the color separation registration as indicated by step 230 of methodology 200. However, if result_1 was obtained then methodology 200 would proceed to step 234 which may result in shifting the second color separation in the negative of the first direction 604, (however, patches 600 and 602 are not shown being consistent with result_1).

This methodology may proceed by going into a loop via steps 234 and steps 230 until result_2 occurs. Result_2 occurs when, as mentioned supra, the approximated total areas of coverage of the first and second fine-periodic-patch images as marked on the substrate are approximately equal. Result_2 may occur when, (1) a color separation registration having no error exists, (2) a half-period color separation registration error exists, or (3) a full-period color separation registration error exists.

Figure 7A:
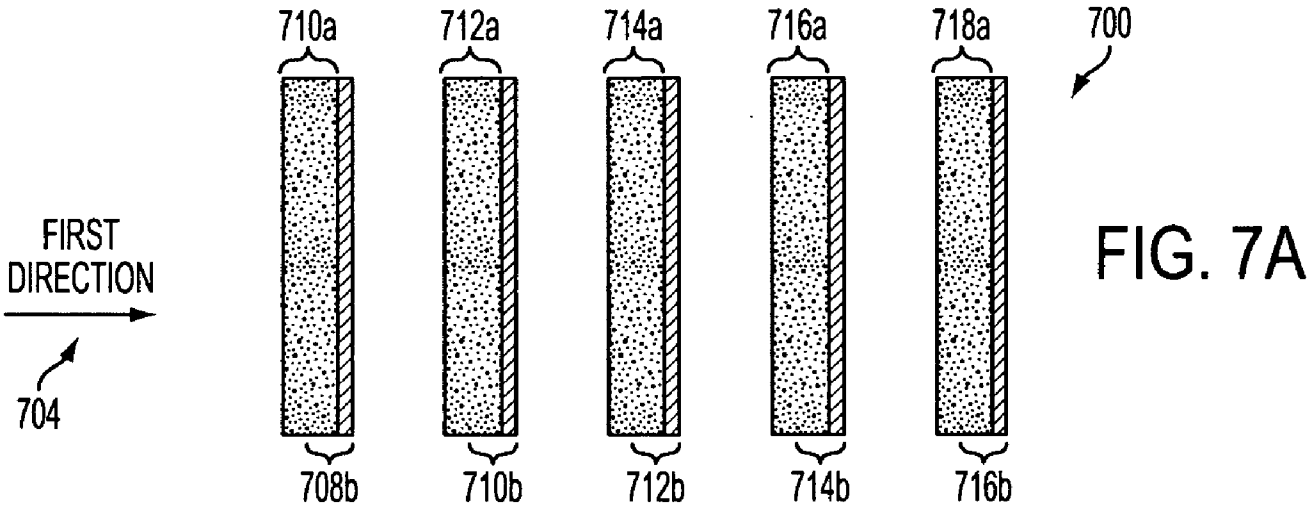
FIGS. 7A and 7B are graphics of two close-up views of two fine-periodic-patch images as marked on a substrate when an about half-period color separation registration error exists in accordance with the present disclosure.
Figure 7B:
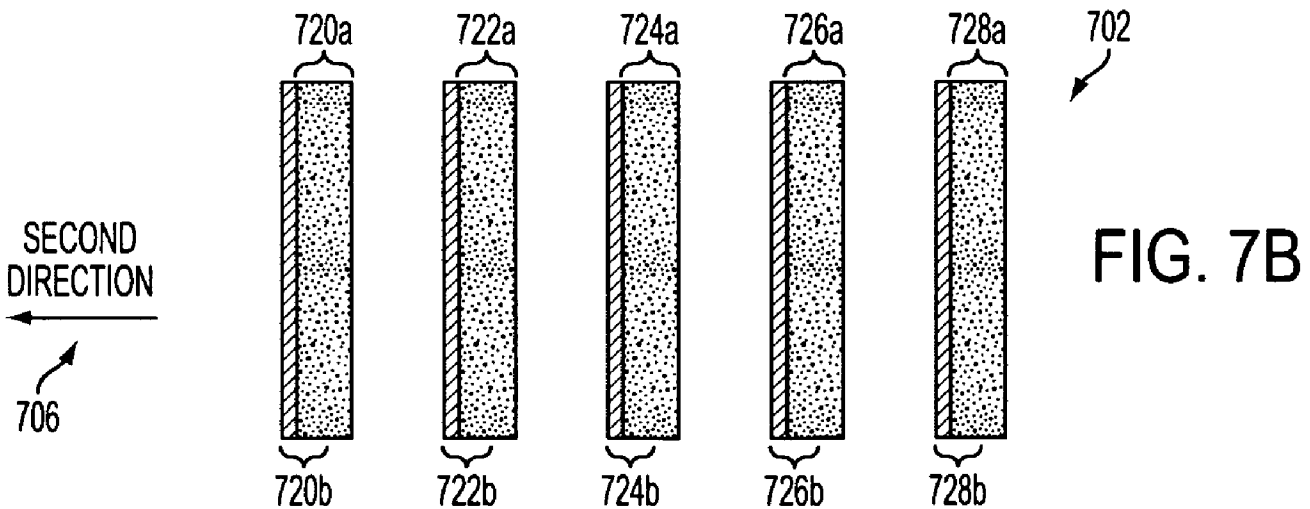

Refer to FIGS. 7A and 7B which illustrate graphics of two close-up views of two fine-periodic-patch images 700 and 702 as marked on the substrate when an about half-period color separation registration error exists in accordance with the present disclosure. Note that the total areas of coverage are approximately equal although a color separation registration error of Δ exists between the first and second color separation. Therefore, the IRD sensor readings taken at steps 220 and 222 still results in result_2 despite that there is a color separation registration error of a half-period. Because method 200 needs additional detection methodology to distinguish whether no color separation registration error exists or a half-period color separation registration error exists as illustrated by FIGS. 7A and 7B, the step of 236 includes methodology 300.

Figure 8A:
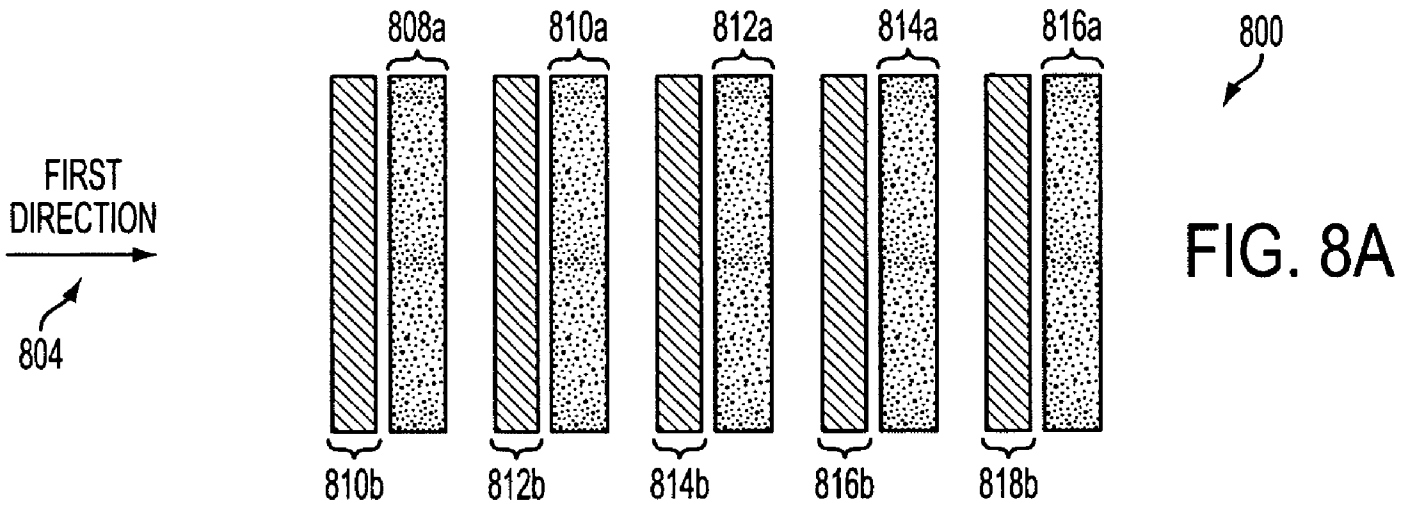
FIGS. 8A and 8B are graphics of two close-up views of two fine-periodic-patch images as marked on a substrate when an about full-period color separation registration error exists in accordance with the present disclosure.
Figure 8B:
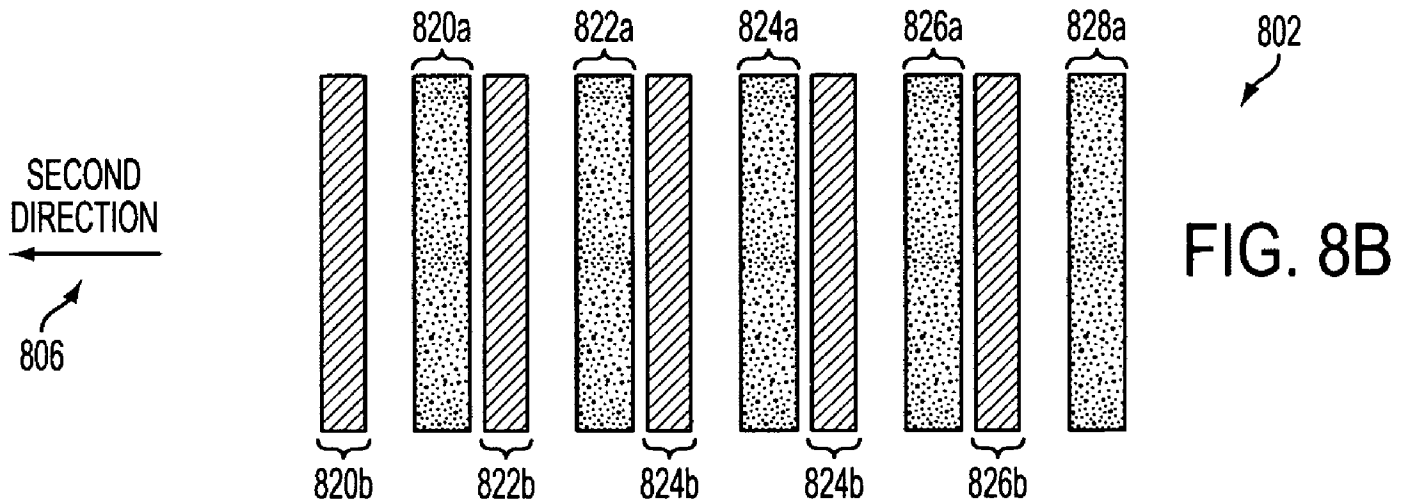

Refer to FIGS. 8A and 8B which illustrate graphics of two close-up views of two fine-periodic-patch images 800 and 802 as marked on the substrate when an about full-period color separation registration error exists in accordance with the present disclosure. Note that the total areas of coverage are approximately equal although a color separation registration error of Δ exists between the first and second color separation. Therefore, the IRD sensor readings taken at steps 220 and 222 still results in result_2 despite that there is a color separation registration error of a full-period. Because method 200 needs additional detection methodology to distinguish whether no color separation registration error exists or a half-period color separation registration error exists as illustrated by FIGS. 8A and 8B, the step of 236 includes methodology 400.

After result_2 is obtained either methodology 200 may proceed to methodology 300 or in another embodiment to methodology 400, both within step 236 of methodology 200. Step 236 is determining whether an at least an about half-period color separation registration error exists between the first and second color separations, which includes methodology 300 which is determining whether an about half-period color separation registration error exists between the first and second color separations.

Figure 3A:
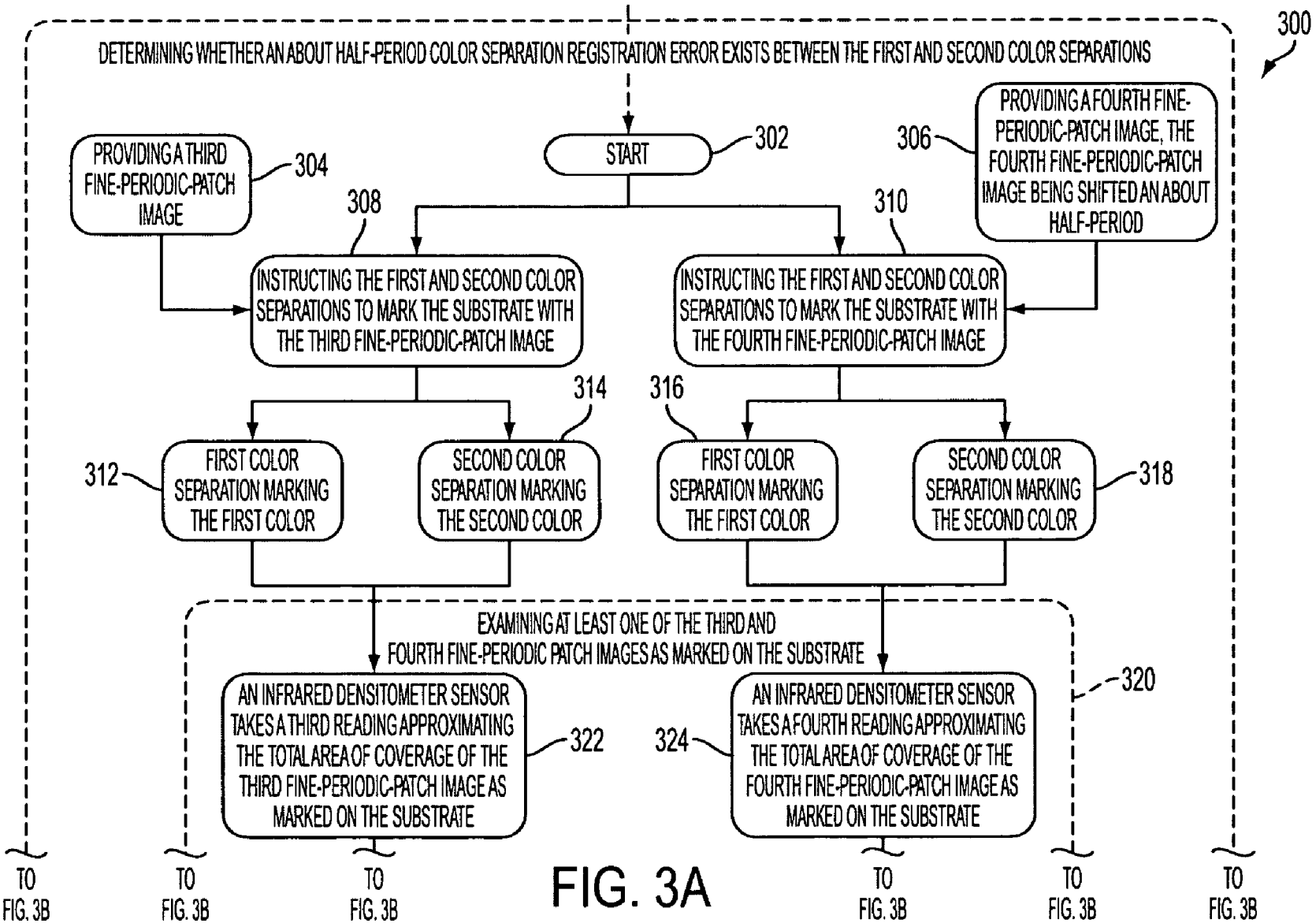
FIGS. 3A-3B are flow chart diagrams depicting a methodology that includes a step for determining whether an about half-period color separation registration error exists between the first and second color separations in accordance with the present disclosure.
Figure 3B:
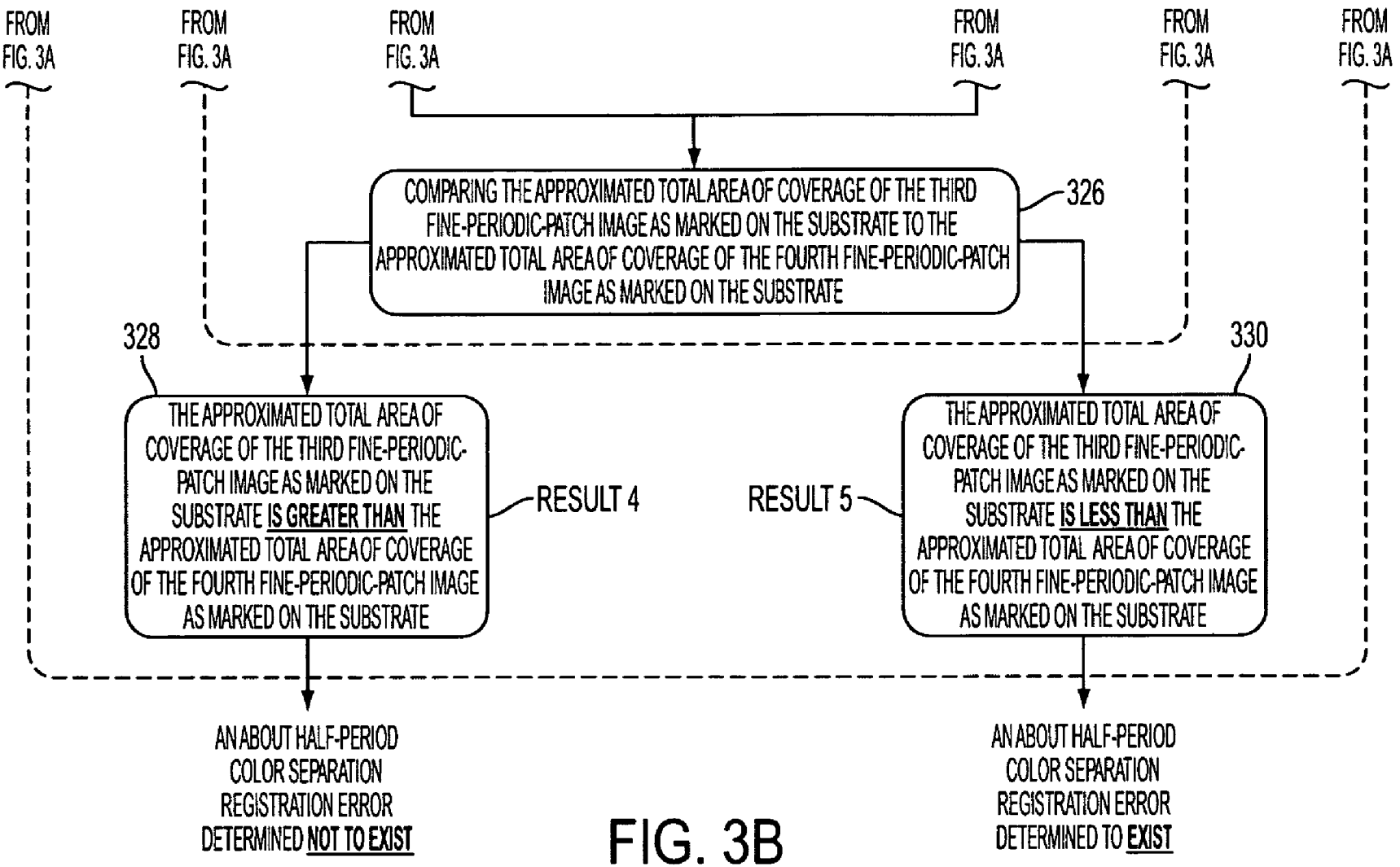

Now with reference to FIGS. 3A-3B, the determination begins at step 302. At steps 304 and 306, third and fourth fine-periodic-patch images, respectively, are provided by the system 100. At step 308, the first and second color separations are instructed to mark the third fine-periodic-patch image on the substrate, and at step 310, the first and second color separations are instructed to mark the fourth fine-periodic-patch image on the substrate.

At steps 312 and 314, the first and second color separations, respectively, mark the first and second colors on the substrate as instructed in step 308. At steps 316 and 318, the first and second color separations, respectively, mark the first and second colors on the substrate as instructed in step 310.

Figure 9A:
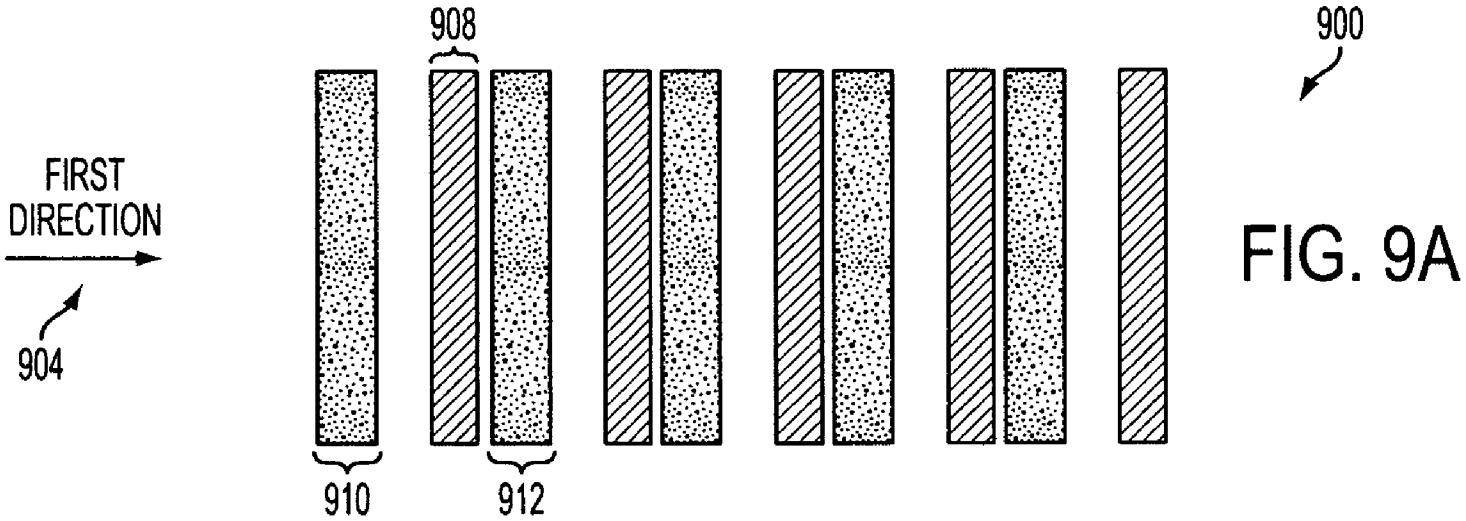
FIGS. 9A and 9B are graphics of two close-up views of two fine-periodic-patch images used for determining whether an about half-period color separation registration error exists in accordance with the present disclosure.
Figure 9B:
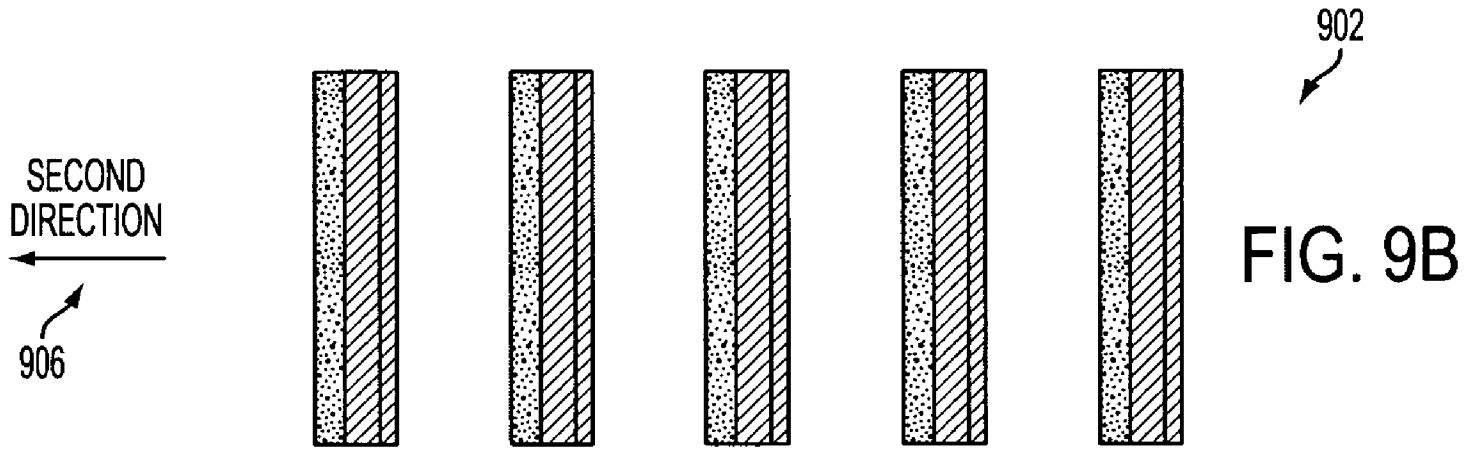

The third fine-periodic-patch image referred to in step 304 and fourth fine-periodic-patch-image referred to in step 306 may be image 900 of FIG. 9A and image 902 of FIG. 9B, respectively. Note that image 902 is shifted a half-period of the second separation in the second direction or the first separation in the first direction. The period of images 900 and 902 may be 16 pixels.

Methodology 300 may proceed to step 320 which includes examining at least one of the third and fourth fine-periodic-patch images as marked on the substrate. When there exists no color separation registration error, images 900 and 902 (see FIGS. 9A and 9B) may appear substantially similar to themselves when marked on a substrate; however, images 900 and 902 may appear substantially similar to patches 1000 and 10002, respectively, when an about half-period color separation registration error exists. Additionally or alternatively, images 900 and 902 may appear substantially similar to patches 1000 and 1002 when a color separation registration error of T/2×(n), exists where n is a positive integer, the IRD will have a same reading as when a half-period registration error exists. Note that image 900 has a higher total area of coverage than patch 1000 while image 902 has a lower area of coverage than patch 1002. This "flipping" of the high and low areas of coverage may be from a direct result of a half-period color separation registration error and, as mentioned supra, is detectable.

During sub-step 322 of step 320, an IRD sensor takes a first reading approximating the total area of coverage of the third fine-periodic-patch image as marked on the substrate; during sub-step 324 of step 320, an IRD sensor takes a second reading approximating the total area of coverage of the fourth fine-periodic-patch image as marked on the substrate.

Figure 10A:
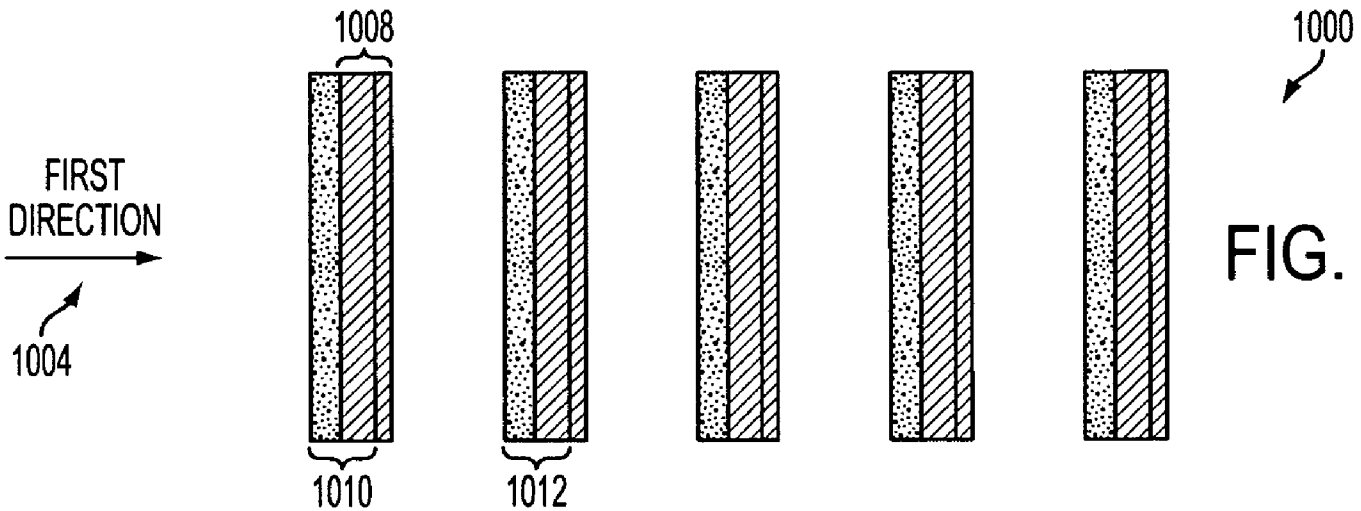
FIGS. 10A and 10B are graphics of two close-up views of the two fine-periodic-patch images of FIGS. 9A and 9B as marked on a substrate when an about half-period color separation registration error exists in accordance with the present disclosure.
Figure 10B:
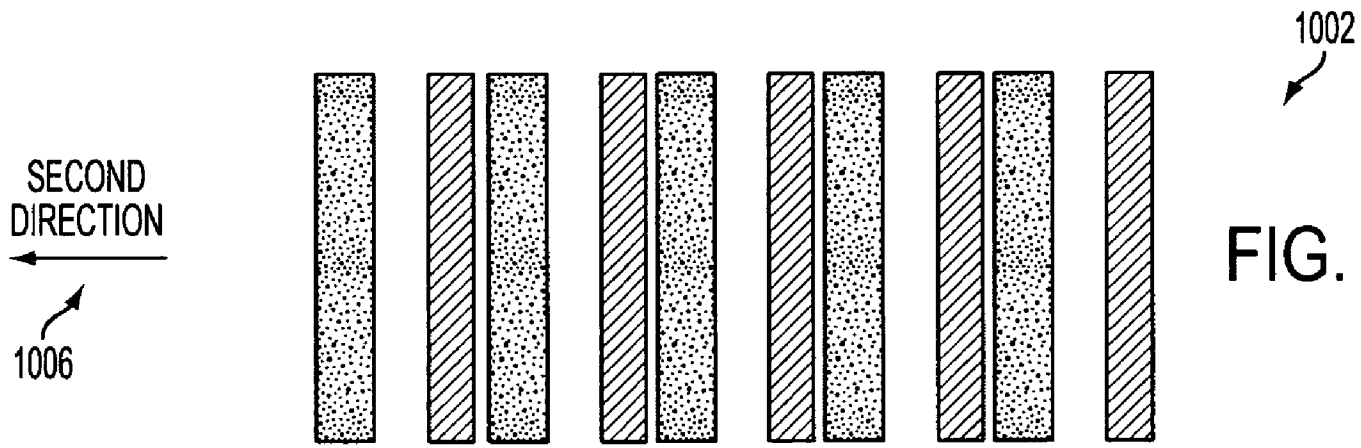

At sub-step 326 of step 320, the approximated total area of coverage of the third fine-periodic-patch image as marked on the substrate is compared to the approximated total area of coverage of the fourth fine-periodic-patch image as marked on the substrate. If, in the example thus far described, the approximate total area of coverage of patch 1000 is greater than the approximated total area of coverage of patch 1002, then result_4 occurs and methodology 300 continues to step 328 (note that FIGS. 10A-10B are not depicted this way). However, if the approximated total area of coverage of patch 1000 is less than the approximated total area of coverage of patch 1002, then methodology 300 continues to step 330 and result_5 occurs.

Figure 4A:
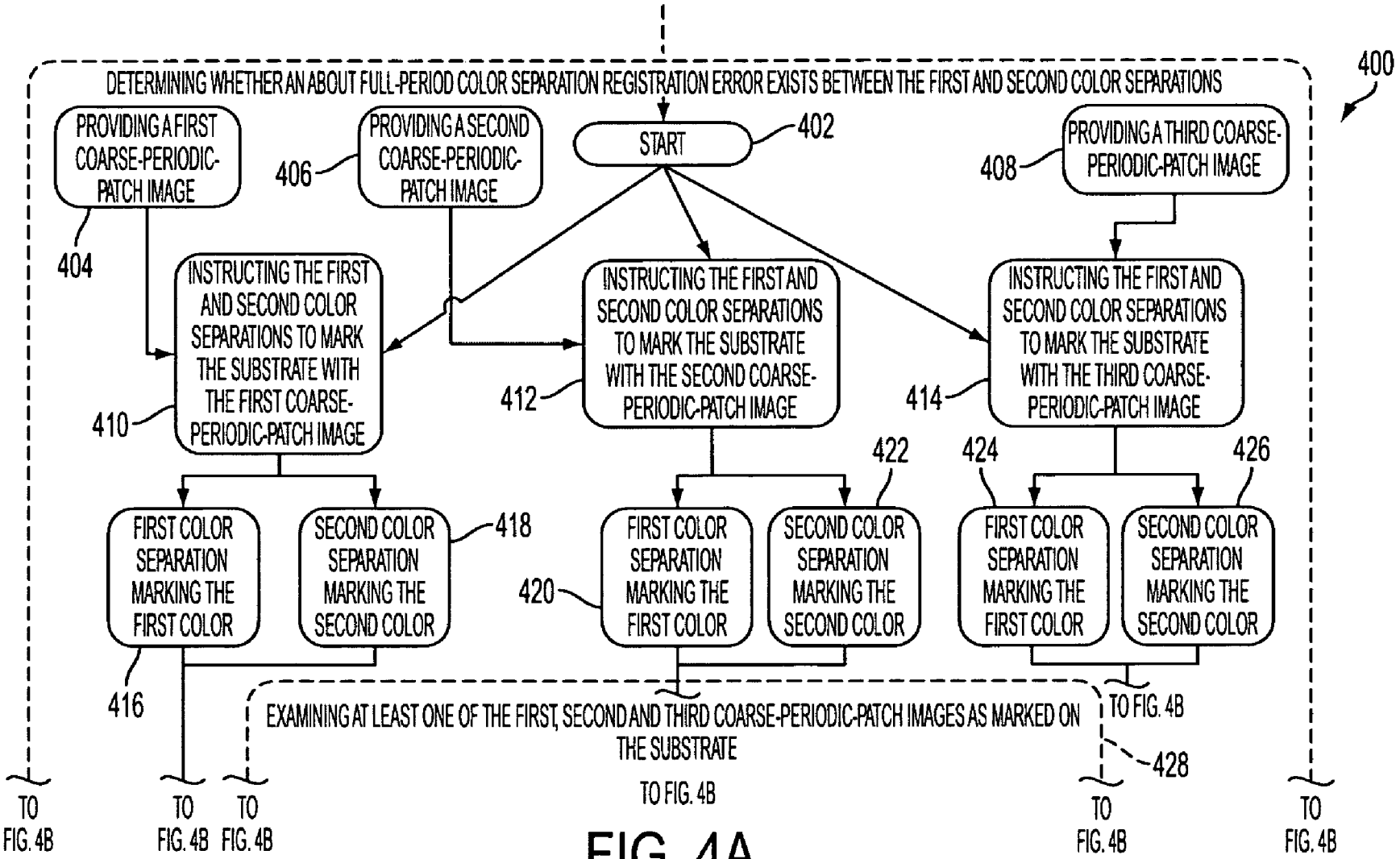
FIGS. 4A-4B are flow chart diagrams depicting a methodology that includes a step for determining whether an about full-period color separation registration error exists in accordance with the present disclosure.
Figure 4B:
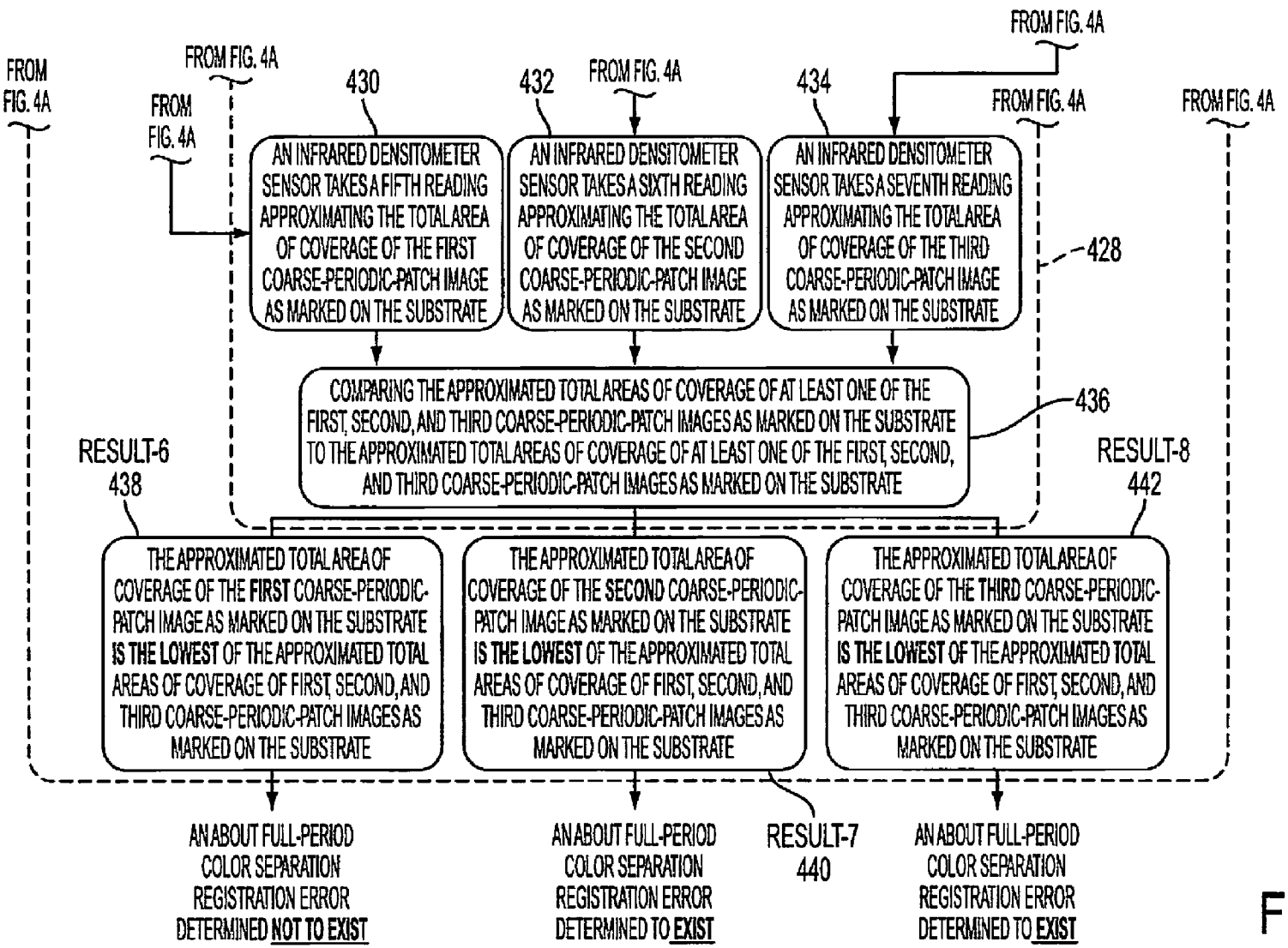

If result_4 occurs it is determined by system 100 that a half-period shift does not exist and the process may proceed to methodology 400 illustrated by FIGS. 4A-4B (or in another embodiment to step 202 as shown by the broken line B in FIGS. 2A-2B. If result_5 occurs it has been determined that an about half-period color separation registration error exists between the two color separations (e.g., the first and second color separation); or, a multiple of a half-period as described supra color separation registration error exists. If system 100 detects a color separation registration error via result_5, then methodology 200 may proceed to 238 to shift the color separation registration a half-period. However, system 100 may not be able to detect which way to shift either color separation registration. System 100 may simply "guess" or use heuristics to determine which way to shift a color separation registration. For example, consider the case illustrated by a half-period color separation registration error of patches 1000 and 1002. System 100 may shift the second color separation in the first direction if, based upon heuristics, the half-period color separation registration error is more likely to exists in this configuration.

The process then proceeds to methodology 400 as illustrated by FIGS. 4A-4B to determine whether an about full-period color separation registration error exists between the first and second color separations (see FIGS. 2 and 4).

With reference to FIGS. 4A-4B, step 402 starts the methodology 400. Then steps 404, 406 and 408 respectively provide a first, second, and third coarse-periodic-patch images to steps 410, 412 and 414. At steps 410, 412 and 414, the system 100 instructs the first and second color separations to respectively mark the substrate with the first, second and third coarse-periodic-patch images. The first and second color separations at steps 416 and 418; steps 420 and 422; and steps 424 and 426, respectively, mark the first and second colors for the first, second and third coarse-periodic-patch images. The first, second, and third coarse-periodic-patch images may the images shown in FIG. 11A, FIG. 11B, and FIG. 11C, respectively. Note that FIG. 11A has the lowest total area of coverage.

Methodology 400 then provides for examining at least one of the first, second, and third coarse-periodic-patch images as marked on the substrate at step 428. Step 428 may include steps 430, 432, and 434 which is an IRD sensor taking a fifth, sixth, and seventh reading approximating the total areas of coverage of the first, second, and third coarse-periodic-patch images as marked on the substrate, respectively. Methodology 400 then provides for comparing the approximated total areas of coverage of at least one of the first, second, and third coarse-periodic-patch images as marked on the substrate to the approximate total areas of coverage of at least one of the first, second and third coarse-periodic-patch images as marked on the substrate.

Figures 11A, 11B, 11C:
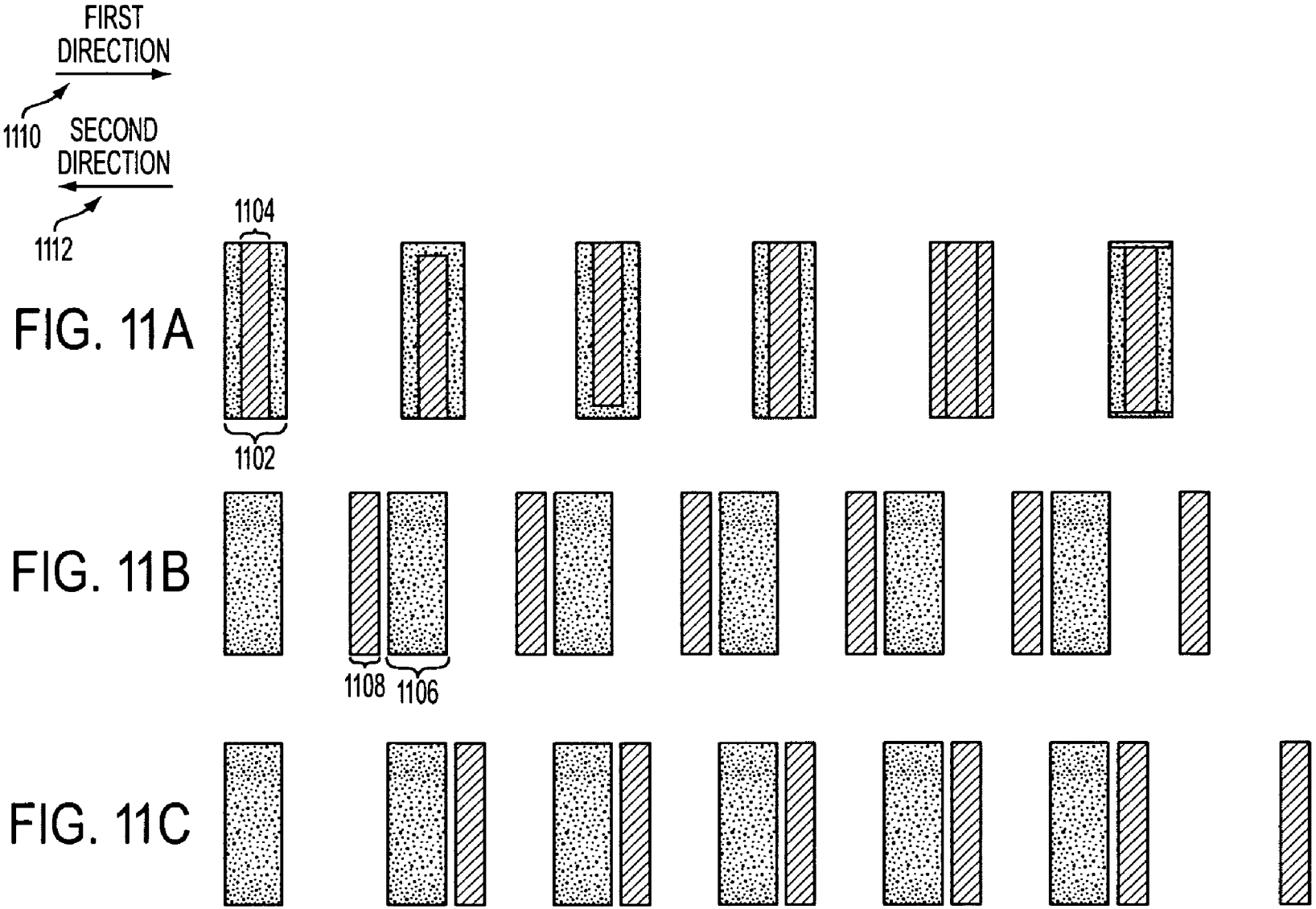
FIGS. 11A, 11B, and 11C are graphics of close-up views of three coarse-periodic-patch images used for determining whether an about full-period color separation registration error exists between the first and second color separations in accordance with the present disclosure.

Referring simultaneously to FIGS. 4, 11A-11C, 12A-12C, and 13A-13C, during steps 410, 412, and 414, the first and second separations are instructed to mark coarse-periodic-patch images shown in 11A, 11B, and 11C, respectively. However, coarse-periodic-patch images shown in 11A, 11B, and 11C may appear substantially similar to themselves or substantially similar to the patch images shown FIGS. 12A-12C or FIGS. 13A-13C. If the images as marked are similar to FIGS. 11A-C, then no color separation registration error exists, which causes result_6 to occur. The image as shown in FIG. 11A has the lowest of the approximated total area of coverage. If result_6 occurs then system 100 continues along methodology 400 towards 438 that is labeled as the approximated total area of coverage of the first coarse-periodic-patch images as marked on the substrate (may be the image of FIG. 11A as marked on a substrate) is the lowest of the approximated total areas of coverage of the first, second, and third coarse-periodic-patch images as marked on the substrate (illustrated by FIGS. 11A-11C).

Figures 12A, 12B, 12C:
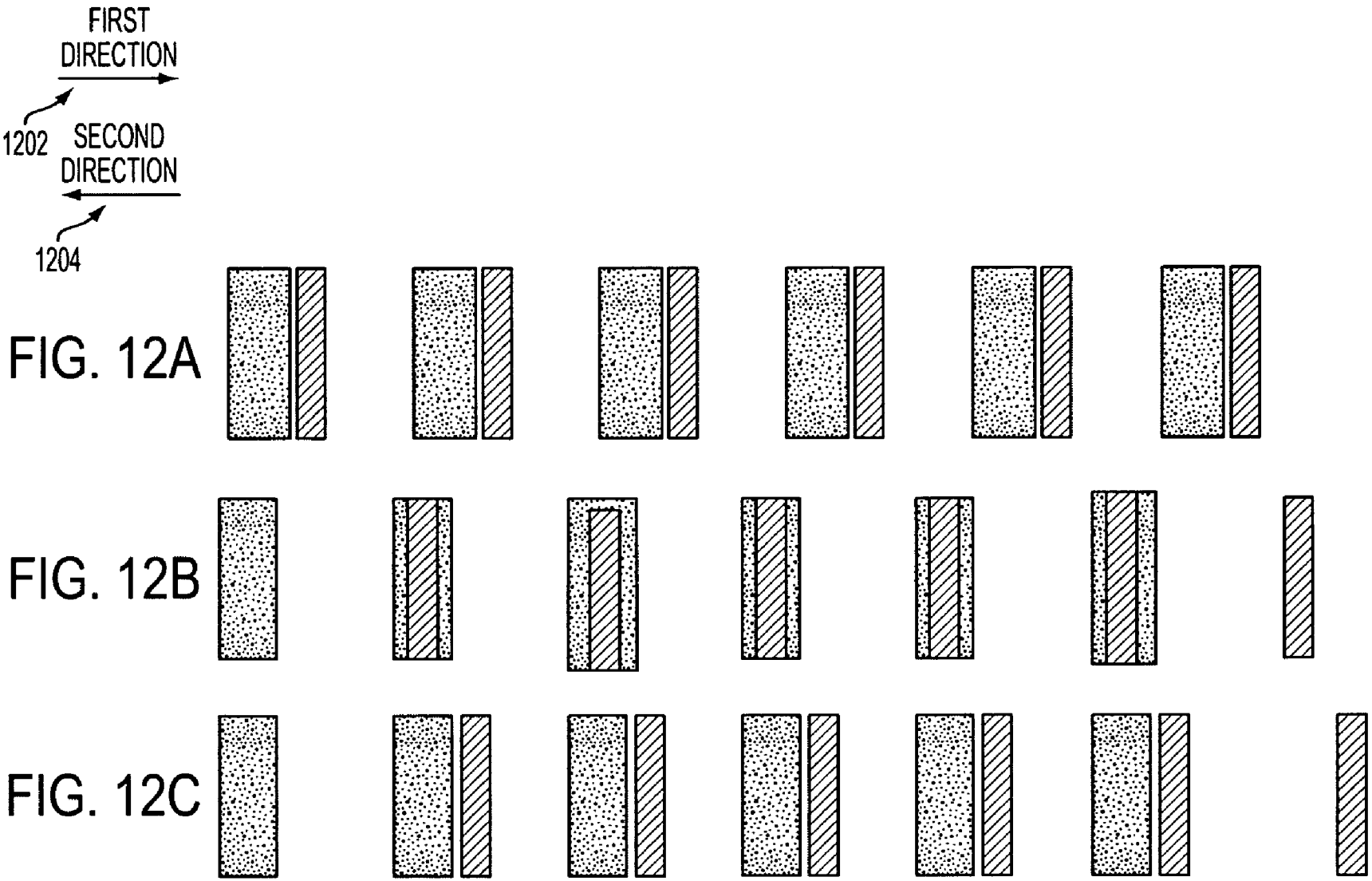
FIGS. 12A, 12B, and 12C are graphics of close-up views of the three coarse-periodic-patch images as marked on a substrate when an about full-period color separation registration error exists in accordance with the present disclosure.

However, if the resulting three coarse-periodic-patch images as marked on the substrate appear substantially similar to FIGS. 12A-12C then the patch of FIG. 12B is the lowest resulting in result_7 and methodology proceedings along towards 440 and a full-period color separation registration error is determined to exist. The color separation registration error may be a color separation registration error of the second color separation in the first direction 1202 of a full-period or a color separation registration error of the first color separation in the second direction 1204.

Figures 13A, 13B, 13C:
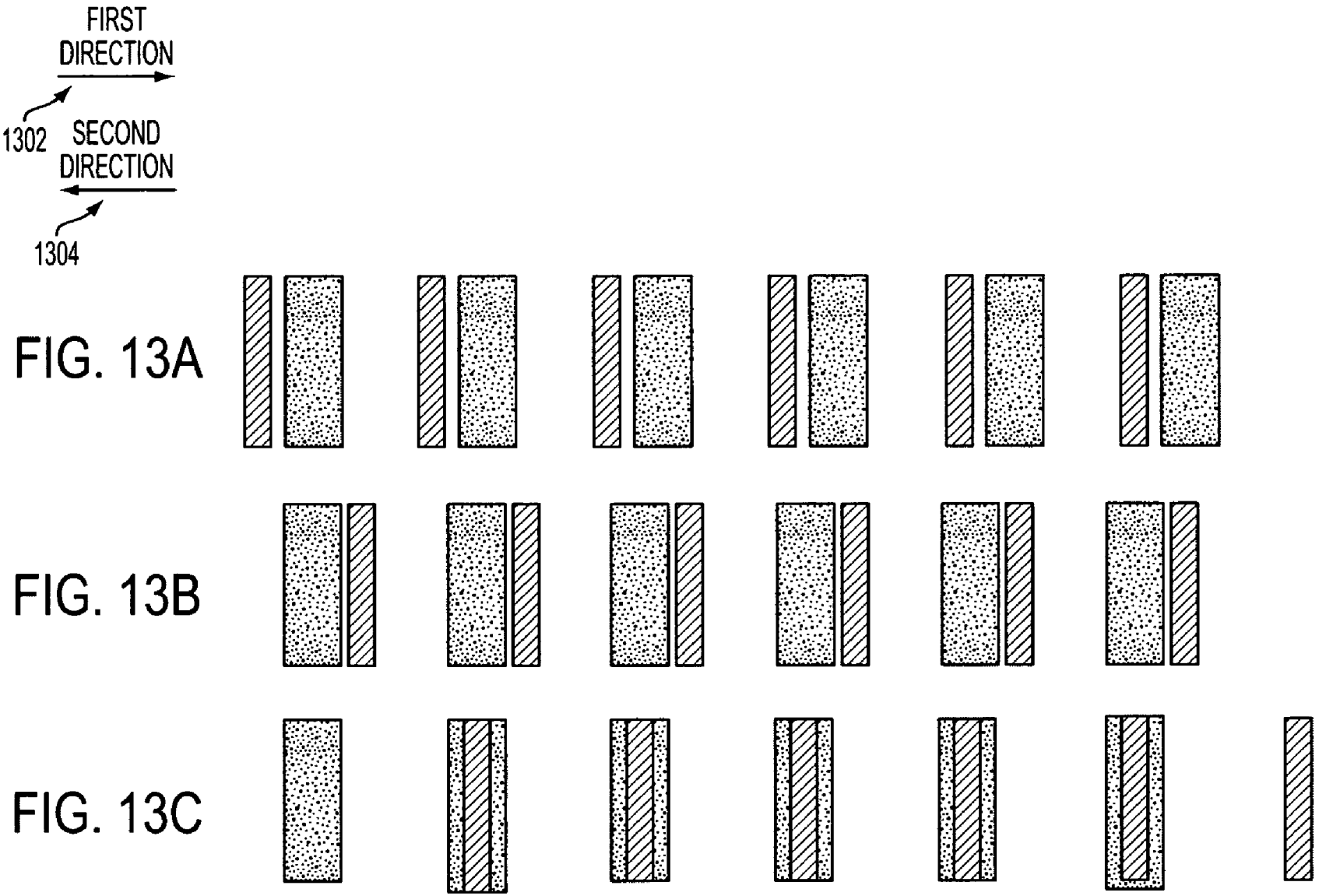
FIGS. 13A, 13B, and 13C are graphics of close-up views of the three coarse-periodic-patch images as marked on a substrate when an about full-period color separation registration error exists, differing with FIGS. 12A-12C in the relative direction of the color separation registration error in accordance with the present disclosure.

Additionally, if the resulting three coarse-periodic-patch images as marked on the substrate appear substantially similar to FIGS. 13A-13C then the patch of FIG. 13C is the lowest resulting in result_8 and methodology proceedings along towards 442 and a full-period color separation registration error is determined to exist. The color separation registration error may be a color separation registration error of the second color separation in opposite to first direction 1202 of a full-period or a color separation registration error of the first color separation in opposite to second direction 1204.

With reference to FIGS. 2A-2B, if it is determined by methodology 400 that an about full-period color separation registration error exists between the first and second color separations, the color separation registration is shifted a full-period in step 240 and the process continues to step 202 and methodology 200 is repeated.

The three coarse-periodic-patch images 1100, 1102, 1104 may have a 48 pixel period pattern with the second color separation lines of 1102 and 1104, being shifted −16 pixels and +16 pixels, respectively. The first separation may be 6 pixels on and 42 pixels off of all of images 1100, 1102, and 1104, the lines being on top of each other in image 1100. The second color separation lines of images 1100, 1102, and 1104 may be 4 pixels on and 44 pixels off, with the shifts mentioned supra. However, such large lines may result in increased noise and/or too narrow of a field of view of an IRD system, so an aliasing coarse-periodic-patch images dimensions may be used.

In another embodiment, FIGS. 11A through 11C, are configured to measure a full-period color separation by having a line pattern that utilizes aliasing. Considering a 24 full period pattern where the second color separation lines are shifted 0, +8, and −8 of FIGS. 11A, 11B, and 11C, respectively.

In another embodiment, FIGS. 11A through 11C, are configured to measure a full-period color separation by have a line pattern that utilizes aliasing having a 12 pixel full-period pattern where the second color separation lines are shifted 0, +4, and −4 of FIGS. 11A, 11B, and 11C, respectively.

Figure 14:
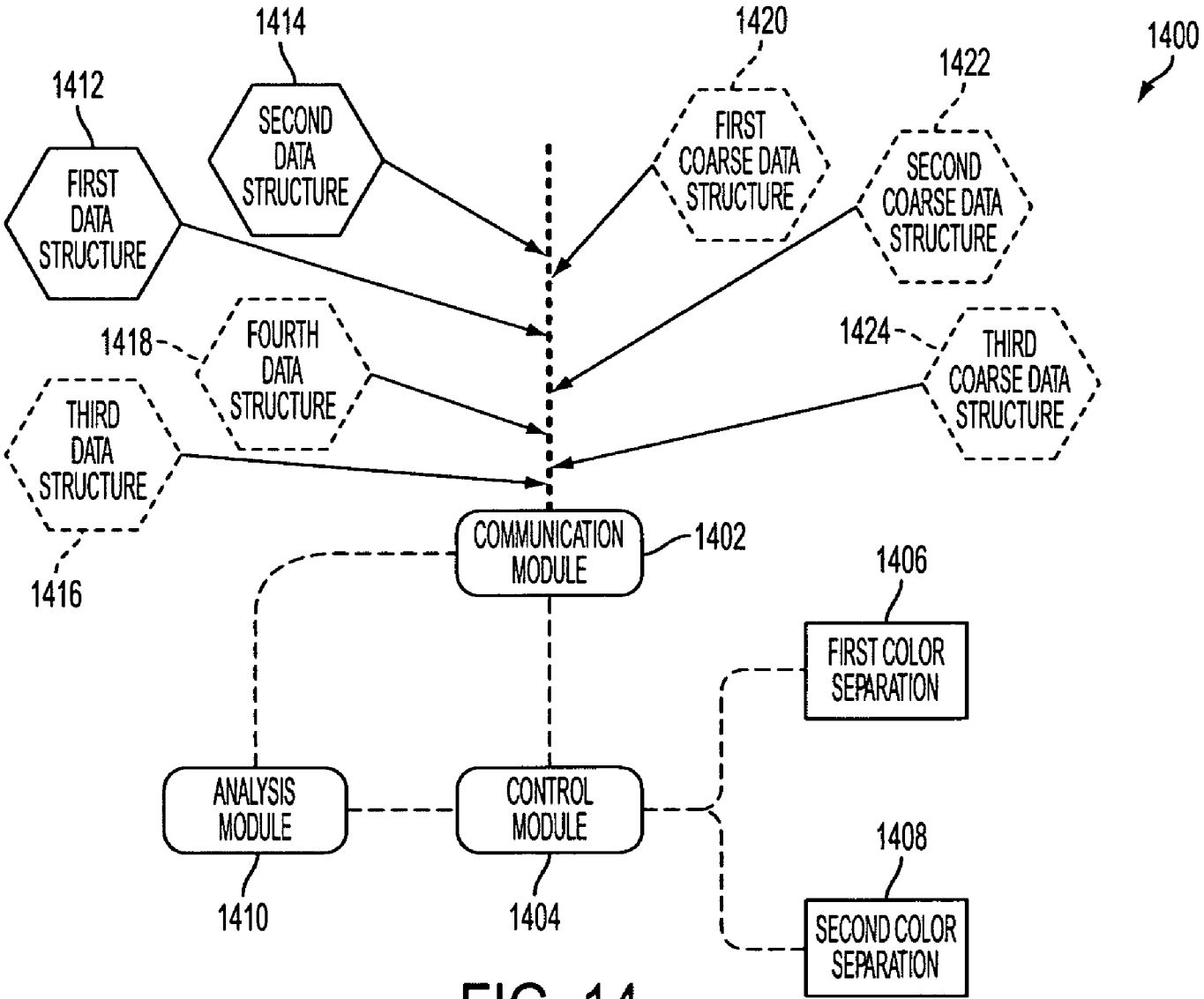
FIG. 14 is a block diagram depicting a system for determining color separation registration error with capability for determining whether at least an about half-period color separation registration error exists between first and second color separations in accordance with the present disclosure.

Referring now FIG. 14, a system 1400 is depicted and includes communication module 1402 and control module 1404. Control module 1404 may control first color separation 1406 and second color separation 1408. The control module may instruct the first color separation 1406 and/or second color separation 1408 to mark a fine-periodic-patch image, a coarse-patch image and/or a coarse-periodic patch image. Control module 1404 may implement methodologies 200, 300 and/or 400. Additionally or alternatively, system 1400 may be utilized by system 100. First data structure 1412, second data structure 1414, third data structure 1416, and fourth data structure 1418 may relate to the first, and second fine-period-patch image of FIGS. 2A-2B, and the third, and fourth fine-periodic-patch images of FIGS. 3A-3B, respectively.

Additionally or alternatively, first coarse data structure 1402, second coarse data structure 1422, and third coarse data structure 1424 may relate to the first, second, and third coarse-periodic-patch images of FIGS. 4A-4B. System 1400 may be configured to utilize methodologies 200, 300, and/or 400 for determining color separation registration errors. Analysis module 1410, which is in operative communication with control module 1404, determines whether an about half-period or full-period color separation registration error exists between the first and second color separations, such as by comparing the approximated total area of coverage of marked patches, e.g. in accordance with methodologies 200, 300 and 400.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method performed by a processor executing an operative set of processor executable instructions for rectifying color separation registration error in a multi-color printing system, the method comprising:

instructing by the processor first and second color separation devices marking first and second color separations, respectively, to mark a substrate with a first fine-periodic-patch image based on a first period;

instructing by the processor the first and second color separation devices to mark the substrate with a second fine-periodic-patch image based on the first period;

comparing by the processor densities of the marked first and second fine-periodic-patch images; and adjusting the color printing system by the processor for at least partially rectifying the color separation registration error by shifting marking of the second color separation relative to marking of the first color separation, wherein a direction of the shifting is based on a result of the comparing.

2. The method according to claim 1, wherein the first fine-periodic-patch image is configured to have a reduced total area of coverage as marked on the substrate when greater than an approximate no color separation registration error to less than an about half-period color separation registration error of the second color separation in a first direction exists, wherein the reduced total area of coverage of the first fine-periodic-patch image as marked on the substrate is relative to the total area of coverage of the first fine-periodic-patch image as marked on the substrate when there is substantially no color separation registration error.

3. The method according to claim 2, wherein the second fine-periodic-patch image is configured to have a reduced total area of coverage as marked on the substrate when greater than an approximate no color separation registration error to less than an about half-period color separation registration error of the second color separation in a second direction exists, wherein the reduced total area of coverage of the second fine-periodic-patch image as marked on the substrate is relative to the total area of coverage of the second fine-periodic-patch image as marked on the substrate when there is substantially no color separation registration error.

4. The method according to claim 1, wherein the first fine-periodic-patch image includes at least one line pair having first and second lines, wherein the first line is formed of the first color separation and the second line is formed of the second color separation.

5. The method according to claim 4, wherein the second fine-periodic-patch image includes at least one line pair having first and second lines, wherein the first line of the second fine-periodic-patch image is formed of the first color separation, and the second line of the second fine-periodic-patch image is formed of the second color separation.

6. The method according to claim 5, wherein the first fine-periodic-patch image has the first line adjacent to the second line in a first direction, wherein the second fine-periodic-patch image has the first line adjacent to the second line in a second direction.

7. The method according to claim 1, wherein the method further comprises at least one of:

determining by the processor whether an about half-period color separation registration error exists between the marked first and second color separations; and determining by the processor whether an about full-period color separation registration error exists between the marked first and second color separations, wherein the half-period and full-period color separation registration errors are based on the first period.

8. The method according to claim 7, wherein the step of determining whether an about half-period color separation registration error exists comprises:

instructing the first and second color separation devices to mark the substrate with a third fine-periodic-patch image based on the first period, the third fine-periodic-patch image including at least one pair of a first line associated with the first color separation and a second line associated with the second color separation;

instructing the first and second color separation devices to mark the substrate with a fourth fine-periodic-patch image based on the first period, wherein the fourth fine-periodic-patch image includes the at least one pair of the first line and the second line, wherein the second line is shifted an about half-period relative to the first line; and examining at least one of the third and fourth fine-periodic-patch images as marked on the substrate.

9. The method according to claim 8, wherein the step of examining at least one of the third and fourth fine-periodic-patch images as marked on the substrate comprises:

comparing the approximated total area of coverage of the third fine-periodic-patch image as marked on the substrate to the approximated total area of coverage of the fourth fine-periodic-patch image as marked on the substrate; and determining whether an about half-period color separation registration error exists based on the comparison.

10. The method according to claim 7, wherein the step of determining whether an about full-period color separation registration error exists comprises:

instructing the first and second color separation devices to mark the substrate with each of a first, second and third coarse-patch image, wherein the first, second and third coarse-patch images are configured for the first coarse-patch image to have the least total area of coverage as marked on the substrate relative to the total area of coverage of the marked second and third coarse-patch images when substantially no full-period color separation registration error exists, for the second coarse-patch image to have the least total area of coverage as marked on the substrate relative to the total area of coverage of the marked first and third coarse-patch images when an about full-period color separation registration error exists in at least one of the second color separation in a first direction and the first color separation in a second direction, and the third coarse-patch image to have the least total area of coverage as marked on the substrate relative to the total area of coverage of the marked first and second coarse-patch images when an about full-period color separation registration error exists in at least one of the second color separation in the second direction and the first color separation in the first direction.

11. The method according to claim 10, wherein at least one of the first, second and third coarse-patch images is configured to have dimensions conducive to aliased readings.

12. The method according to claim 10, wherein at least one of the first, second and third coarse-patch images is a coarse-periodic-patch image based on a second period that is larger than the first period.

13. The method according to claim 10, wherein the step of determining whether an about full-period color separation registration error exists further comprises:

examining at least one of the first, second, and third coarse-patch images as marked on the substrate.

14. The method according to claim 13, wherein the step of examining at least one of the first, second, and third coarse-patch images as marked on the substrate comprises:

comparing the approximated total areas of coverage of the first, second, and third coarse-patch images as marked on the substrate; and determining whether an about full-period color separation registration error exists based on the comparison.

15. A computer-readable medium storing a series of programmable instructions configured for execution by at least one processor for estimating color separation registration error comprising the steps of:

instructing first and second color separation devices marking first and second color separations, respectively, to mark a substrate with a first and a second fine-periodic-patch image both based on a first period; and comparing densities of the marked first and second fine-periodic-patch images; and adjusting marking of the first and second color separations for rectifying color separation registration error by shifting marking of the second color separation relative to marking of the first color separation, wherein a direction of the shifting is based on a result of the comparing.

* * * * *